US009562698B2

(12) United States Patent
Cote

(10) Patent No.: US 9,562,698 B2
(45) Date of Patent: Feb. 7, 2017

(54) PASSIVE CONSTANT PRESSURE HATCH FOR FRESH AIR DIRECT FIRED GAS HEATED VENTILATION SYSTEMS

(71) Applicant: Anthony Cote, Prevost (CA)

(72) Inventor: Anthony Cote, Prevost (CA)

( * ) Notice: Subject to any disclaimer, the term of this patent is extended or adjusted under 35 U.S.C. 154(b) by 585 days.

(21) Appl. No.: 13/922,008

(22) Filed: Jun. 19, 2013

(65) Prior Publication Data

US 2014/0373826 A1 Dec. 25, 2014

(51) Int. Cl.

| | |
|---|---|
| ***F24H 3/02*** | (2006.01) |
| ***F24D 19/10*** | (2006.01) |
| *F24D 5/04* | (2006.01) |

(52) U.S. Cl.

CPC ..... *F24D 19/1084* (2013.01); *F24D 5/04* (2013.01)

(58) Field of Classification Search

CPC ..... F16K 17/12; Y02B 30/28; F24F 11/047; F24F 11/043; F24F 2011/0035; F24F 2011/0038; F24F 2011/0047; F24F 2011/0049; F24F 2011/0052; F24F 2011/0057; F24F 2011/0073; F24F 2011/0082; F24F 2011/0087; F24F 2013/0608; F24F 3/00; F24F 3/044; B60H 1/00828

USPC ..... 137/875; 432/56; 454/266, 275; 126/293

See application file for complete search history.

(56) References Cited

U.S. PATENT DOCUMENTS 1,830,036 A * 11/1931 Mortimer ..... F23L 11/02 126/285 R
1,975,316 A * 10/1934 Ferris ..... F24F 7/00 454/333
2,297,757 A * 10/1942 Field, Jr. ..... F23L 11/02 220/825
3,183,930 A * 5/1965 Barr ..... F24F 11/047 137/875
3,417,977 A 12/1968 Nelson
(Continued)

OTHER PUBLICATIONS

"DF Modular Heater", Website Link: https://www.captiveaire.com/CATALOGCONTENT/FANS/SUP_AD/DOC/EXPLODED%20VIEW%20-%20DIRECT%20FIRED.PDF, 2000.
(Continued)

*Primary Examiner* — Jason Lau

(74) *Attorney, Agent, or Firm* — Wells St. John P. S.

(57) ABSTRACT

A fresh air heating system includes air intake and discharge chambers, a direct-fired gas burner mounted in a burner chamber in fluid communication with intake and discharge chambers therebetween, and a bypass opening between the air intake and discharge chambers that is selectively closed by a hatch cover having a panel and a peripheral wall extending from the panel. The hatch cover is movable between a first position wherein the hatch cover closes the bypass opening and the panel is positioned substantially horizontal and a second position wherein the hatch cover is lifted away from the bypass opening so as to minimize variations of air pressure differential across the bypass opening; the hatch cover being configured to lift away from the bypass opening when there is a positive variation of pressure between the air intake and discharge chambers, wherein the peripheral wall allows minimizing aerodynamic lift and the inherent reduction of static pressure under the panel when the hatch cover is lifted away from the bypass opening.

15 Claims, 16 Drawing Sheets

(56) References Cited

U.S. PATENT DOCUMENTS 3,591,150 A 7/1971 Weatherston
3,782,448 A * 1/1974 Clark ..... F24F 3/0522 165/127
3,783,363 A * 1/1974 Kraft ..... G05D 16/202 318/481
4,176,587 A * 12/1979 Cox ..... F24F 7/007 454/251
4,191,209 A * 3/1980 Mattson ..... F24F 11/047 137/486
4,276,725 A * 7/1981 Ash ..... E04B 1/98 49/141
4,325,352 A * 4/1982 Dirkes ..... F24H 3/0488 126/110 A
4,403,599 A * 9/1983 Copenhaver ..... F23M 9/006 110/162
4,429,679 A 2/1984 Dirkes
4,573,912 A * 3/1986 Albritton ..... F24H 3/0488 126/110 C
4,674,475 A 6/1987 Powis
4,829,447 A 5/1989 Parker et al.
4,917,074 A * 4/1990 Brekke ..... F24H 3/0488 126/110 A
5,195,927 A * 3/1993 Raisanen ..... A01K 1/0064 137/527.8
5,257,958 A * 11/1993 Jagers ..... F24D 19/1084 236/13
5,365,975 A * 11/1994 Cote ..... F16K 17/12 137/527.8
5,597,354 A 1/1997 Janu et al.
5,775,988 A * 7/1998 Eakin ..... A01K 1/0064 454/253
5,915,960 A * 6/1999 Check ..... F24H 3/0488 126/110 C
5,983,930 A * 11/1999 Nordenberg ..... F16K 1/20 137/1
6,629,523 B2 * 10/2003 Saltzman ..... F24C 15/20 126/110 A
2011/0277484 A1 * 11/2011 Dominiak ..... F01D 25/12 60/801

OTHER PUBLICATIONS

Ashrae Guideline 16/2003, "Selecting Outdoor, Return, and Relief Dampers for Air-Side Economizer Systems", American Society of Heating, Refrigerating and Air Conditioning Engineers, Inc., 2003.

* cited by examiner

PASSIVE CONSTANT PRESSURE HATCH FOR FRESH AIR DIRECT FIRED GAS HEATED VENTILATION SYSTEMS

BACKGROUND

The present disclosure relates to direct gas-fired heated ventilation systems for industrial and commercial buildings, and particularly to systems which use variable amounts of fresh air.

More specifically, the present disclosure relates to a constant pressure self adjusting burner bypass for such direct gas-fired heated ventilation systems.

Direct gas-fired heated ventilating systems provide heated make-up air to buildings by drawing fresh air into them then exhausting it into a building. Such make-up air is necessitated by the loss of heated inside air through various exhaust fans and chimney flues. The quantity of heated replacement air is usually substantially equal to the exhausted heated air. To prevent infiltration of cold outside air, it is also common practice to provide slightly more make-up air than is lost so that a slight positive pressure is maintained inside the building. The operation of the heated ventilation system is controlled to maintain a selected inside air temperature and a desired building inside/outside air pressure differential. This type of heated ventilation system is commonly called a make-up air unit. Generally, it is not permitted to use a direct gas-fired heated ventilating systems to heat a building because the combustion gases are introduced into the building. It can only be used to heat replacement air.

There are two basic types of direct gas-fired make-up air units (DGF make-up air unit). A first basic type includes a fresh air intake which communicates with a chamber containing a direct gas-fired burner. The burner heats the air as it is drawn or blown over the flame by a blower fan. The heated fresh air and the combustion gases are exhausted into the building. In some of such systems, the amount of air being exhaust out of the building may vary requiring that the make-up air also vary. In some systems, the rotational speed of the blower fan is controlled to vary the amount of heated make-up air generated, and in other systems the blower fan is turned on and off as needed.

An inherent characteristic of known DGF make-up air units is that the airflow velocity at the burner must remain constant to maintain optimum combustion chemistry. To allow variable quantities of heated air to be introduced into the building, the quantity of air heated by the burner is made constant and a variable quantity of replacement air is then shunted passed the burner unheated and then mixed with the fixed quantity of heated air such that the resulting mixture will be at the desired temperature. Example systems of this type are disclosed in U.S. Pat. No. 3,591,150, issued on Jul. 6, 1971 to Weatherston and titled "Gas Furnace" and U.S. Pat. No. 4,325,352 issued on Apr. 20, 1982 to Dirkes and titled "Internal Recirculation Device".

The second basic type of system recirculates inside air and mixes it with the heated fresh air before delivering it to the inside space. These systems include a recirculating air intake which draws air from inside the building and mixes it with the heated fresh air. With this system type, the airflow through the replacement air blower fan remains constant. Dampers control the relative amounts of each air stream. Examples of this type of direct gas-fired air make-up units are disclosed in the following references:

U.S. Pat. No. 3,417,977, issued on Dec. 24, 1968 to Nelson and titled "Air Control System for Heating Unit";

U.S. Pat. No. 4,429,679, issued on Feb. 7, 1984 to Dirkes and titled "Modular Air Heater";

U.S. Pat. No. 4,573,912, issued on Mar. 4, 1986 to Albritton et al. and titled "Space Heater";

U.S. Pat. No. 4,674,475, issued on Jun. 23, 1987 to Powis and titled "Gas Fired Furnace"; and U.S. Pat. No. 4,917,074, issued on Apr. 17, 1990 to Brekke and titled "Direct gas-Fired Heating and Ventilation Method and Apparatus".

As mentioned above, the air stream over the direct gas-fired burner is maintained at a constant velocity for optimum combustion. This implies that the pressure drop across the burner be maintained at a substantially constant level. In the above-cited patents this is achieved by controlling dampers that supply air to the burner or dampers that shunt air around the burner. In all cases, the dampers are either controlled by complex interlocking mechanisms, linkages with springs or counterweights or are separately controlled by electronic controllers. Such control methods are disclosed in the following documents:

U.S. Pat. No. 4,829,447, issued on May 9, 1989 to Parker et l. and titled "Bypass Controller and Bypass System";

U.S. Pat. No. 5,257,958, issued on Nov. 2, 1993 to Jagers and titled "Pressure Override Control for Air Treatment Unit";

U.S. Pat. No. 5,597,354, issued on Jan. 28, 1997 to Janu et al. and titled "Indoor Air Quality Control for Constant Volume Heating, Ventilating and Air Conditioning Units";

A known manufacturer of make-up air units, CaptiveAire of Raleigh, N.C., USA, employs vertical spring biased blades on both side of the burner.

SUMMARY

Embodiments of a passive constant pressure hatch (PCP hatch) for regulating the pressure drop over a direct gas-fired burner are provided in a DGF make-up air unit that includes three chambers:

a discharge chamber containing a blower fan;

a burner chamber placed within the discharge chamber, wherein a common opening is made between the discharge chamber and the burner chamber to allow air to pass from the burner chamber to the discharge chamber, and wherein a direct gas-fired burner is mounted in this opening to heat the air passing therethrough; and an intake chamber is mounted within the discharge chamber upstream and adjacent to the burner chamber such that, in operation, air introduced into the intake chamber through an outside air intake opening may flow from the intake chamber to the burner chamber through a common opening.

Heater systems using direct gas-fired burner are often used in air make up units. To maintain a constant airflow at the burner and thus maintain good combustion chemistry, the pressure drop over a direct gas-fired burner must remain substantially constant. A system for air replacement/recirculation as described above can be used to vary the total quantity of air through the DGF air make-up unit but the inclusion of a direct gas-fired burner requires additional components.

A bypass opening is cut in the top of the intake chamber such that air can be shunted as required from the intake chamber through this opening directly into the discharge chamber. An embodiment of a PCP hatch cover is then mounted over the bypass opening to regulate the shunted portion of the intake air.

A passive constant pressure hatch according to illustrative embodiments described herein improves on the constant pressure floating door taught in my U.S. Pat. No. 5,365,975 issued on Nov. 22, 1994 and titled "Constant Air Pressure Unit for Air Handling System" (hereinafter referred to as 'my '975 patent').

As will be explained in more detail below, as the floating door from my '975 patent begins to rise off the bypass opening at the desired pre-set pressure, air begins to escape at its edges. The air velocity close to its edge creates an aerodynamic lift on the perimeter surface of the floating door. This aerodynamic lift tends to draw the floating door back towards the bypass opening and reduces to varying degrees the flow of air. The greater the operating pressure, the greater the reduction in airflow. The net effect of this phenomenon is that the apparent weight of the floating door is increasing as the escaping air flow increases and the aerodynamic lift extends its effect away from the edge of the floating door and over a greater surface of the floating door. At low operating pressures, such as below 0.15" water gauge (w.g.), which was the design criteria for the floating door of my '975 patent, this phenomenon is negligible. The operating pressure required for make-up air units is much higher, above 0.45" w.g. The aerodynamic lift at theses pressures negates the desired constant pressure characteristic of the floating door of my '975 patent.

An object of illustrative embodiments is to provide a PCP hatch for DGF make-up air units that minimize the variation of pressure required to lift the PCP hatch cover.

The problem of the variation of the pressure required to lift a PCP hatch cover is solved by distancing the lifting surface of the hatch cover from the zone of high velocity airflow.

In accordance with an illustrative embodiment, there is provided a direct gas-fired fresh air heating system comprising:

an air intake chamber;

a discharge chamber;

a burner chamber in fluid communication with both the air intake and discharge chambers therebetween;

a direct-gas fired (DGF) heater mounted in the burner chamber to heat air flowing therethrough from the air intake chamber to the discharge chamber; and a passive constant pressure (PCP) hatch including:

a bypass opening between the air intake and discharge chambers to allow air to be shunted passed the burner chamber; and a PCP hatch cover having a top panel covering the bypass opening; the PCP hatch cover being movable between a first position, wherein the PCP hatch cover closes the bypass opening and a second position wherein the PCP hatch cover is lifted away from the bypass opening so as to substantially maintain a fixed pressure differential across the burner chamber; the PCP hatch cover being configured to lift further away from the bypass opening when there is an attempt to increase the pressure differential between the air intake and discharge chambers;

the improvement comprising:

the PCP hatch cover further including a peripheral wall extending from the top panel to distance the top panel from the bypass opening when the PCP hatch cover is in the first position;

whereby negative effects of aerodynamic lift on the top panel and an inherent reduction of static pressure associated thereto, are substantially reduced throughout.

According to another illustrative embodiment, there is provided a passive control hatch cover for selectively closing a bypass opening between an air intake chamber and a discharge chamber, the passive control hatch cover comprising a lifting surface that is distanced from the bypass opening when the passive control hatch closes the bypass opening.

According to still another embodiment, there is provided a constant air pressure unit for an air handling system, said unit comprising a partition therein having an air passage opening to allow pressurized air to fluidly circulate therethrough, a door having a panel displaceably retained over the air passage opening such that, in a closed position of the door, substantially no air can pass through the air passage opening; the door panel having loading means whereby the door is caused to move away from the air passage opening when a pressure differential across the partition attains a desired level; the door panel further allowing the controlled passage of air through the air passage opening while maintaining a substantially constant air pressure differential across the partition, the improvement wherein the door further includes a peripheral wall which comes in contact with the partition when the door fully covers the air passage opening.

A PCP hatch according to embodiments of the present invention is so designed that the air arriving under it lifts it at a pre-set static pressure differential making it float on the air flow. Any attempt to increase the pre-set static pressure differential further raises the PCP hatch cover, letting more air escape. The pre-set static pressure is substantially proportional to its weight divided by the area of the horizontal projection of its top panel.

Generally, the burner opening is sized to allow twenty (20) percent of the total flow rate to pass over the burner at a specified pressure drop (usually between 0.4" and 0.6" w.g.). This flow rate is the minimum airflow capacity of the DGF make-up air unit. The remaining airflow capacity may vary between 0 and 80% of the maximum flow rate as it is shunted passed the burner through the bypass opening.

Constructed as taught in my '975 patent, the operation of a constant pressure floating door works well at relatively low pressure differentials (below 0.15" w.g.). The passive constant pressure hatch according to embodiments of the present invention successfully operates at pressures well above 0.15" w.g.

A passive constant pressure hatch according to an illustrative embodiment maintains a constant air velocity across the direct gas-fired burner by opening and closing as is necessary to shunt air in excess of that required to provide the optimal burner performance. Such a passive constant pressure hatch thereby "regulates" the pressure drop and, thus, the air velocity across the burner.

Such a regulation of the pressure drop across the burner is achieved passively, i.e. that no control system or interconnecting linkages are required to operate the constant pressure hatch. The biasing force supplied by the weight of the floating PCP hatch cover is sufficient to maintain the pressure level required by the direct gas-fired burner.

A quick response time to changes in flow conditions is achieved, compared with conventional pressure regulation means that use control actuators with dampers, resulting in a slow response to changing flow conditions. Firstly, commercially available control actuators have fixed and relatively slow operating speeds. Depending on the rapidity with which the flow conditions change, the damper may be continually attempting to attain the desired pressure differential by playing catch-up. Secondly, commercially available controls signal their damper actuators to open the damper or close the damper but also have a small "no signal" range or dead band where the damper actuator is allowed to stop before changing directions. Thus, the actual pressure differential will remain within plus or minus five percent (5%) of the set pressure differential. These hardware limitations create a lag between the required pressure differential and the actual pressure differential generated by the damper. With a PCP hatch according to an embodiment of the present invention, this inherent time lag of the control actuator is overcome since none is required.

A PCP hatch according to an embodiment of the present invention yields a reliable and inexpensive pressure drop regulator across the burner. No dedicated control systems are required and no complex mechanical linkages, springs, pivot pins or rotating blades are needed to operate the PCP hatch. A PCP hatch according to an embodiment of the present invention operates autonomously to perform the regulation function with only one moving part: the PCP hatch itself, as it floats on a cushion of air in a substantially frictionless fashion.

Other objects, advantages, and features will become more apparent upon reading of the following non-restrictive description of illustrative embodiments thereof, given by way of example only with reference to the accompanying drawings.

DETAILED DESCRIPTION

Figure 1A:
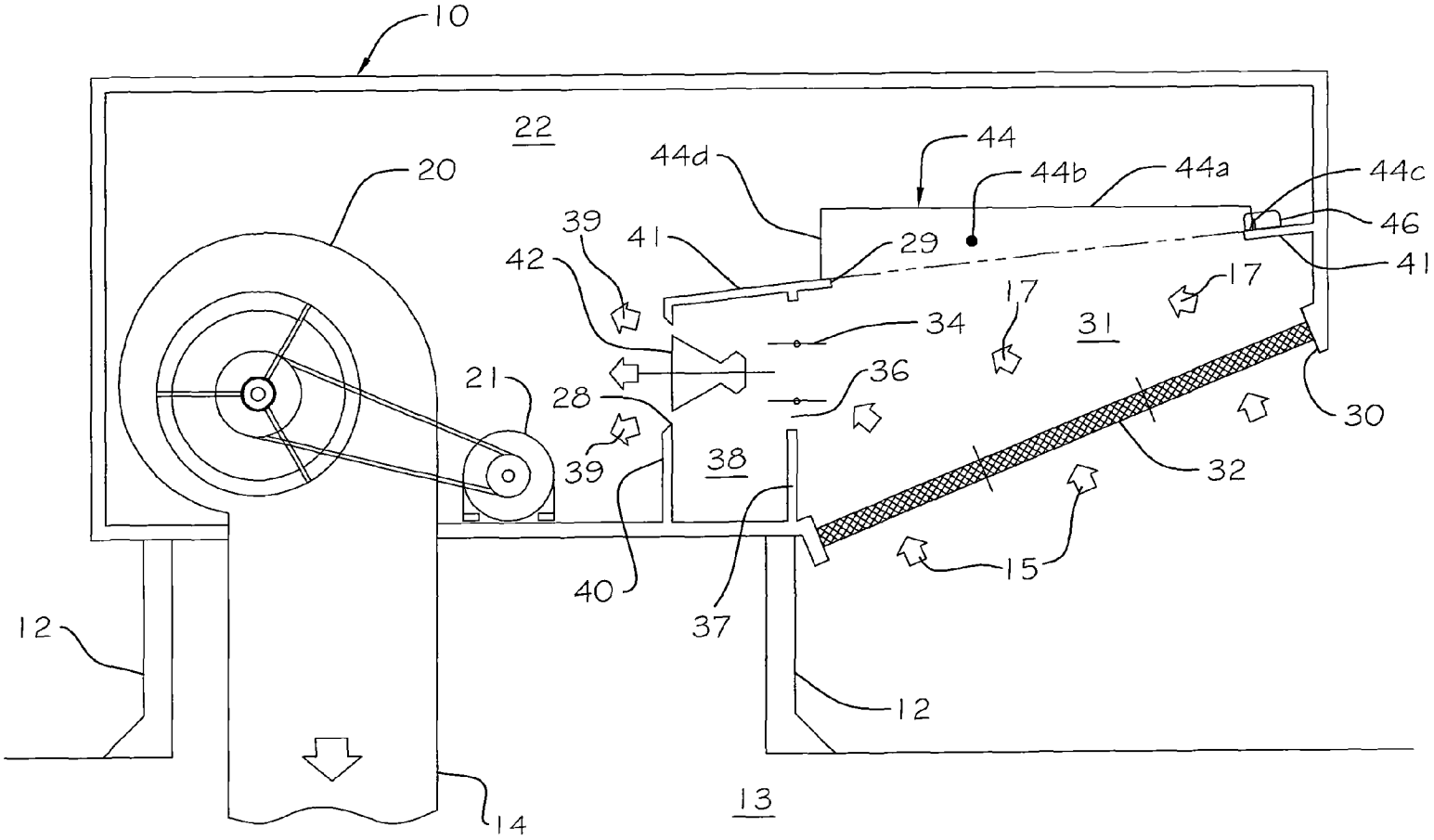
FIGS. 1*a* and 1*b* are cross-sections of a direct gas-fired (DGF) make-up air unit including a passive constant pressure (PCP) hatch according to a first illustrated embodiment; the hatch cover being illustrated respectively in close and open positions.

In the following description, similar features in the drawings have been given similar reference numerals, and in order not to weigh down the figures, some elements are not referred to in some figures if they were already identified in a previous figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

Figure 1B:
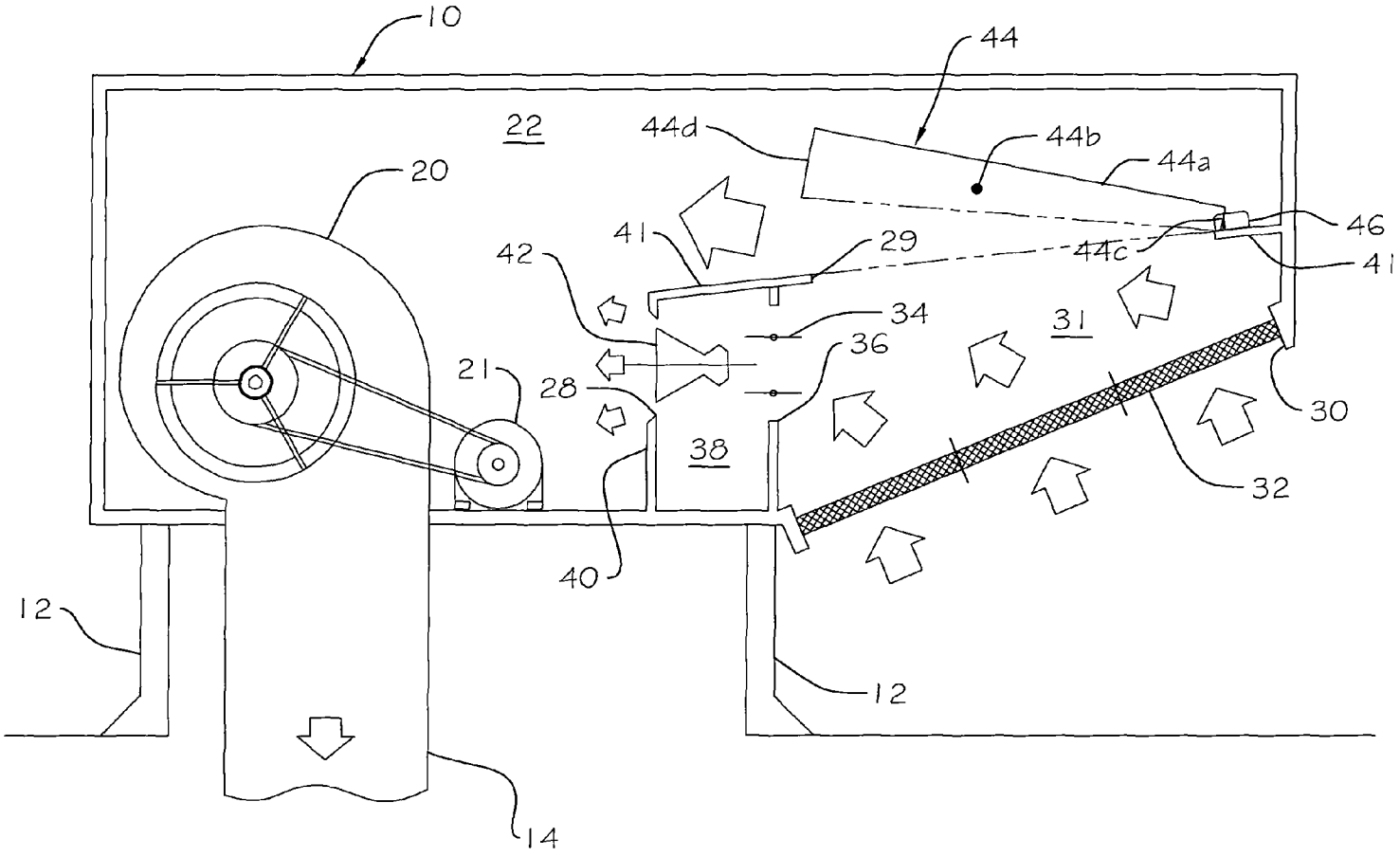

With reference first to FIGS. 1*a* and 1*b*, a heated ventilation system 10 according to a first illustrative embodiment will be described. The system 10 is shown mounted on a roof curb 12 of a building 13.

The system 10 comprises a centrifugal blower fan 20 that draws air from an enclosed discharge chamber 22 and delivers it to the building 13 through the air duct 14. The blower fan 20 is driven by a motor 21 and operated in a well known manner by a control system (not shown) to provide the required amount of air to the building 13.

Fresh outside air (see arrows 15) is drawn in by the blower fan 20 through an intake opening 30 into an intake chamber 31 that is within the discharge chamber 22 (see arrows 17). The intake chamber 31 is defined by side and top dividing walls 40 and 41 within the discharge chamber 22. A bank of air filters 32 are mounted in the intake opening 30 of the intake chamber 31 to filter the fresh air as it enters intake chamber 31.

The system 10 further comprises a burner chamber 38 between the inlet and discharge chambers 31 and 22 so as to be in fluid communication with both chambers 22 and 31. According to the first illustrative embodiment, the burner chamber 38 is defined by a wall 37 within the intake chamber 31 and by the dividing walls 40 and 41.

The burner chamber 38 includes an air inlet opening 36 provided in the wall 37 to allow passage for the fresh air 17 from the intake chamber 31 to enter the burner chamber 38. An inlet damper 34 is mounted in the air inlet opening 36 to shut off the flow of fresh air when the heating and ventilation system 10 is not in use. A control system (not shown) is further provided to operate both the inlet damper 34 and the blower fan 20.

The dividing wall 40 between the burner chamber 38 and discharge chamber 22 has a burner opening 28 through which the heated fresh air (see arrows 39) is drawn into the discharge chamber 22 from the burner chamber 38. An air heater in the form of a direct gas-fired burner 42 is mounted in the burner opening 28. During the heating season, the burner 42 heats that portion of the fresh air drawn through openings 36 and 28, into the discharge chamber 22.

Also, it is to be noted that the relative dimensions of the intake and discharge chambers 31 and 22, of the burner chamber 38 and intake opening 30 are not limitative and the overall configuration of the system 10 is provided for illustrative purposes only. The chambers 22, 31 and 38, and the opening 30 are adapted for example to the dimension of the building 13 and to the air conditioning requirements.

A hatch opening 29 is provided in the dividing wall 41 between the air intake and discharge chambers 22 and 31 such that fresh air may be shunted directly from the intake chamber 31 into the discharge chamber 22 without passing through the burner chamber 38 and around burner 42. A hatch cover 44 is mounted over the hatch opening 29 to control the airflow between intake chamber 31 and discharge chamber 22. As will be described in more detail below, the hatch cover 44 is so designed to maintain a substantially constant air pressure differential across burner opening 28.

Figure 2:
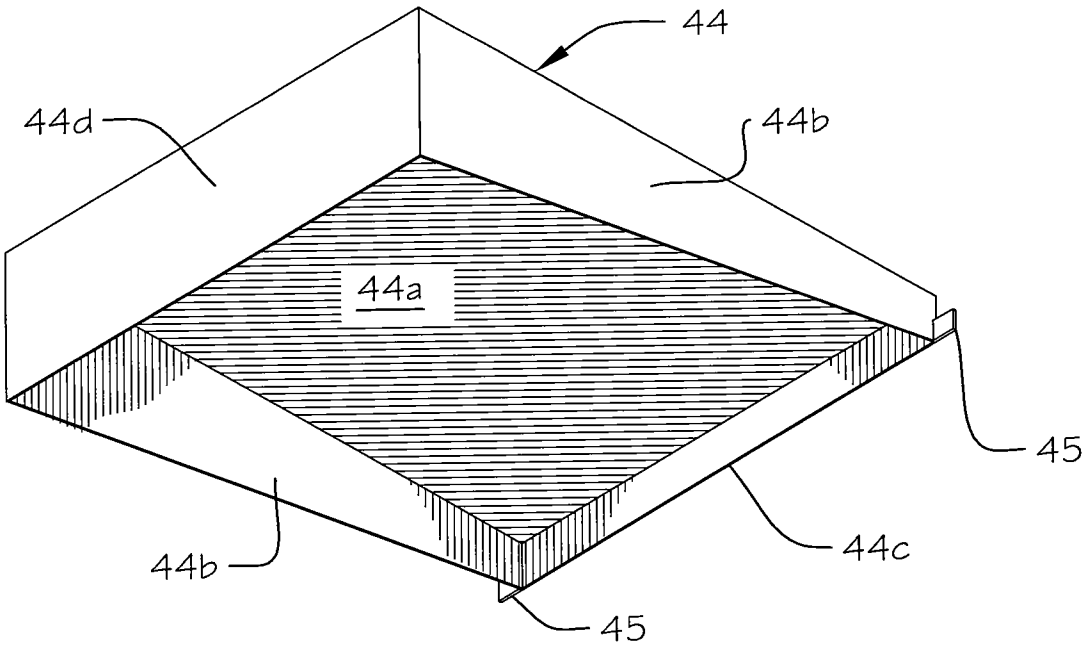
FIG. 2 is a bottom perspective view of the PCP hatch cover shown in FIGS. 1*a* and 1*b;*

With reference to FIG. 2, the hatch cover 44 includes a top panel 44*a*, a pair of spaced sidewalls 44*b*, an upstream wall 44*c* and a downstream wall 44*d*. Returning to FIG. 1*a*, the hatch cover 44 pivotally rests on the dividing wall 41 such that walls 44*a*, 44*c*, 44*d* and 44*b* fully cover the hatch opening 29 and stop the passage of air between the intake chamber 37 and the discharge chamber 22 when a) the heated ventilation system 10 is not in operation or b) the vacuum generated by the blower fan 20 as it draws in fresh air is not sufficient to lift the hatch cover 44.

Figure 3A:
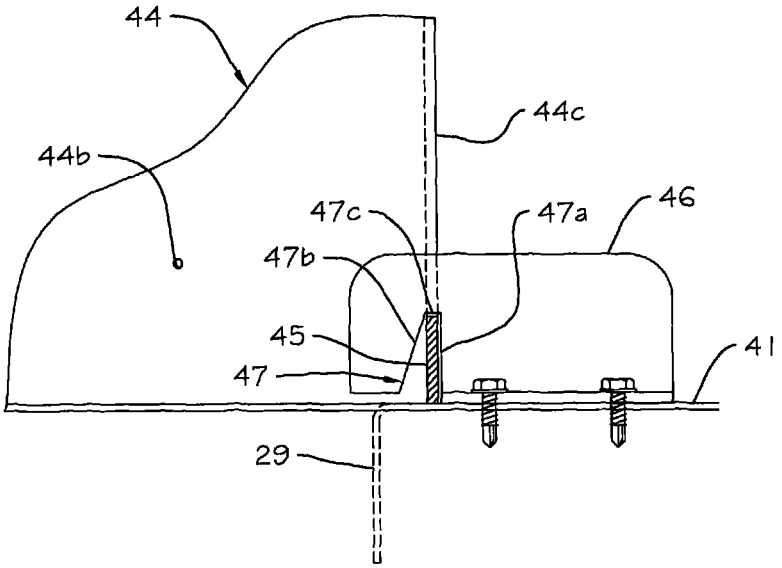
FIGS. 3*a* and 3*b* are close up side elevations of the PCP hatch cover in the position shown respectively in FIGS. 1*a* and 1*b*, showing the pivot means of the PCP hatch cover.

Referring to FIG. 3*a*, the hatch cover 44 is pivotally mounted to the horizontal dividing wall 41 at the upstream wall 44*c* by two pivot tabs 45 (only one shown) and two pivot clips 46 (only one shown). As shown in FIG. 2, the pivot tabs 45 can be formed as lateral extensions of the upstream wall 44*c*. According to another embodiment (not shown), the tabs 45 are fastened to the upstream wall 44*c*.

Referring back to FIGS. 3*a* and 3*b*, the two pivot clips 46 are fixedly attached to the dividing wall 41. A "V" shaped notch 47, having sides 47*a* and 47*b*, is cut in each pivot clip 46 to loosely receive the pivot tabs 45. Sides 47*a* and 47*b* meet at a truncated apex 47*c* having a width substantially equal to the thickness of the pivot tabs 45. Side 47*a* is substantially parallel to upstream wall 44*c*. Side 47*b* is angled with side 47*a* such that tab 45 can pivot about truncated apex 47*c* allowing hatch cover 44 to freely pivot to its maximum open position. The angle between sides 47*a* and 47*b* defines the maximum pivoting angle of the hatch cover 44 with regards to the wall 41.

In the operation of the PCP hatch, whenever the pressure differential between intake and discharge chambers 31 and 22 is greater than the weight of the hatch cover 44 divided by the area of the horizontal projection of the top panel 44*a*, the hatch cover 44 begins to float on a cushion of air and is therefore no longer in contact with dividing wall 41. As the hatch cover 44 begins to rise, pivot tabs 45 rest against pivot clips 46 at truncated apexes 47*c* and the hatch cover 44 begins to pivot upward. The pivoting angle of the hatch cover 44 increases with any attempt to increase the pressure differential up to when the pivot tabs 45 abut the sides 47*b* of notches 47.

Figure 3B:
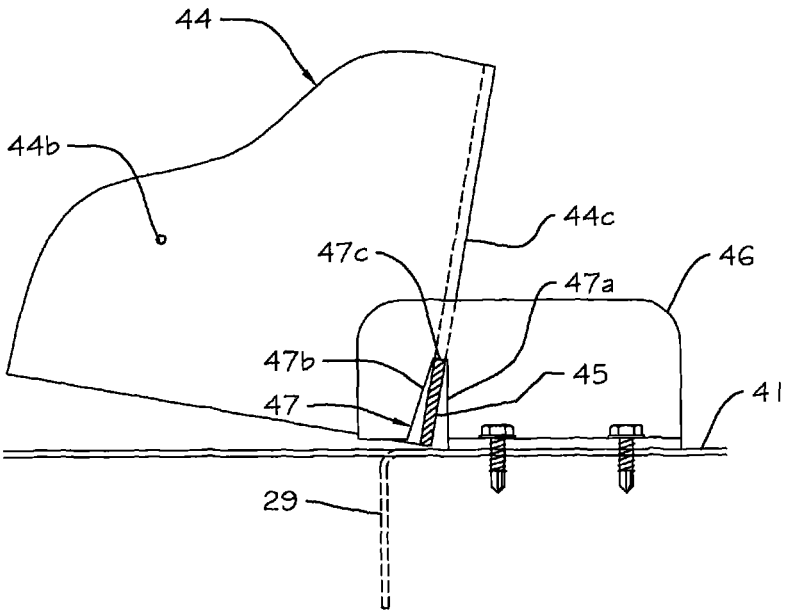

As can be seen in FIG. 3*b*, the height of notch 47 at apex 47*c* is sufficiently greater than the height of the pivot tab 45 to allow free pivoting of pivot tabs 45 when it comes in contact with truncated apex 47*c*. The two pivot clips 46 also prevent lateral movement of the hatch cover 44.

The system 10 and hatch cover 44 are not limited to the illustrated pivotal attachment of the hatch cover 44 to the dividing wall 41. A heated ventilation system according to another embodiment includes a hatch cover that is pivotally secured to the dividing wall using another friction-free pivoting mechanism that the one illustrated in FIGS. 3*a* and 3*b*.

As mentioned above and referring to FIG. 1*b*, an inherent characteristic of known DGF make-up air units is that the airflow velocity at burner 42 must remain substantially constant to maintain optimum combustion chemistry. This implies that to maintain a constant air velocity through burner opening 28, the air pressure differential across it must also remain constant. As will now be explained, this is achieved by the hatch cover 44 without any actuators, springs, or additional linkage.

The hatch cover 44 regulates the air pressure differential across the burner opening 28 and thus the air velocity therein. This is achieved by shunting fresh air from the intake chamber 31 directly into the discharge chamber 22 in sufficient quantity so as to neutralize any change in the pressure differential between the burner chamber 38 and discharge chamber 22.

In order to better explain the operation of the hatch cover 44, the limitation found in a single panel floating door 60 from my '975 patent will first be briefly described.

Considering $W_{hc}$, the weight of the floating door 60, and $A_{hc}$, the area of its horizontal projection, the pressure required to lift hatch cover 60 is equal to $$P_{lift} = \frac{W_{hc}}{A_{hc}} = \text{constant}$$

With the application of pressure $P_{lift}$ under floating door 60, it begins to float on a cushion of air; its displacement being frictionless, only an extremely low force is required to move it. Since the floating door 60 is pivotably mounted over the opening 29, it pivots as the airflow increases consequently to any attempts to increase the pressure $P_{lift}$ under it. However, as the floating door 60 pivots upward, the horizontal distance between its center of gravity and the pivot axis decreases: this causes the floating door 60 to seem slightly lighter as the angle of rotation $A_{lift}$ increases, reducing the pressure $R_{lift}$ required to hold it open. Such a pressure reduction is equal to $$\Delta P_{lift} = R_{lift} \times (1 - \cos(A_{lift})), \text{ where } A_{lift} \text{ is the lift angle in degrees.}$$

It has been found that, for pivoting angles of eight (8) degrees, the reduction of the lifting pressure $P_{lift}$ is one (1) percent; for eleven (11) degrees, the reduction is two (2) percent; and for fourteen (14) degrees, the reduction is three (3) percent. A reduction of two (2) percent can be considered negligible for a typical direct fired gas burner. However, for any greater pivoting angle, the horizontal translation of the center of gravity with regards to the pivot axis should be considered.

It has been found that $\Delta P_{lift}$ is reduced for a given $A_{lift}$ by having the pivoting of the floating door 60 begin at $-\frac{1}{2} A_{lift}$ and by rotating it by $A_{lift}$ to $+\frac{1}{2} A_{lift}$. Thus, for a $A_{lift}$ of eleven (11) degrees, the $\Delta P_{lift}$ is reduced from two (2) percent to 0.5 percent, allowing $A_{lift}$ to be increased to 22 degrees without causing the $\Delta P_{lift}$ to exceed the threshold of negligibility that has been set hereinabove to two (2) percent.

As mentioned hereinabove, the rotation of the floating door 60 may have a detrimental side effect on it constant pressure characteristic. In practice, other phenomena come into play, which limit the use of a single top panel floating door 60.

Figure 4A:
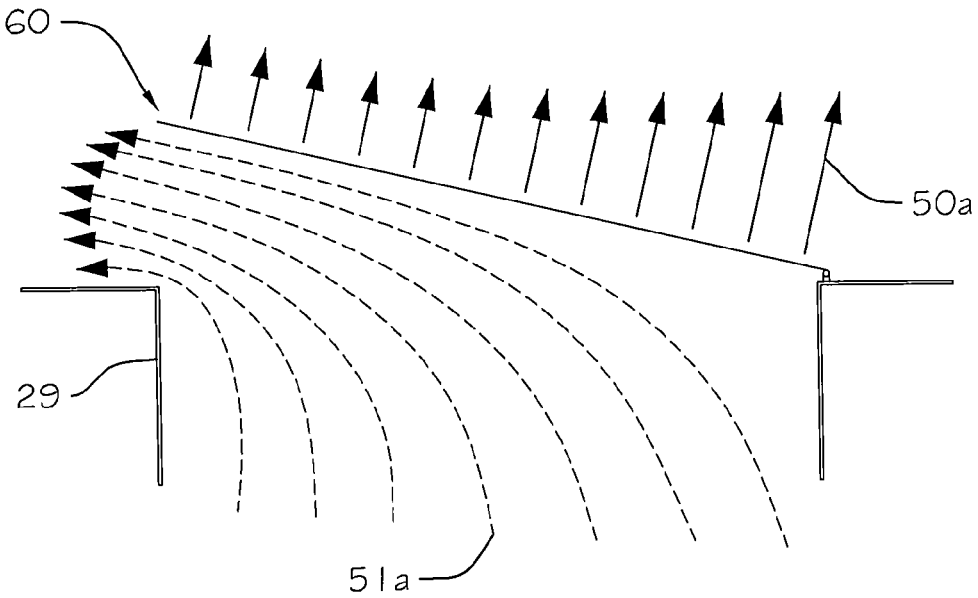
FIG. 4*a*, which is labeled "prior art" is a schematic cross-section of an opened floating door from my '975 patent, showing velocity lines and pressure gradients on the door.
Figure 4B:
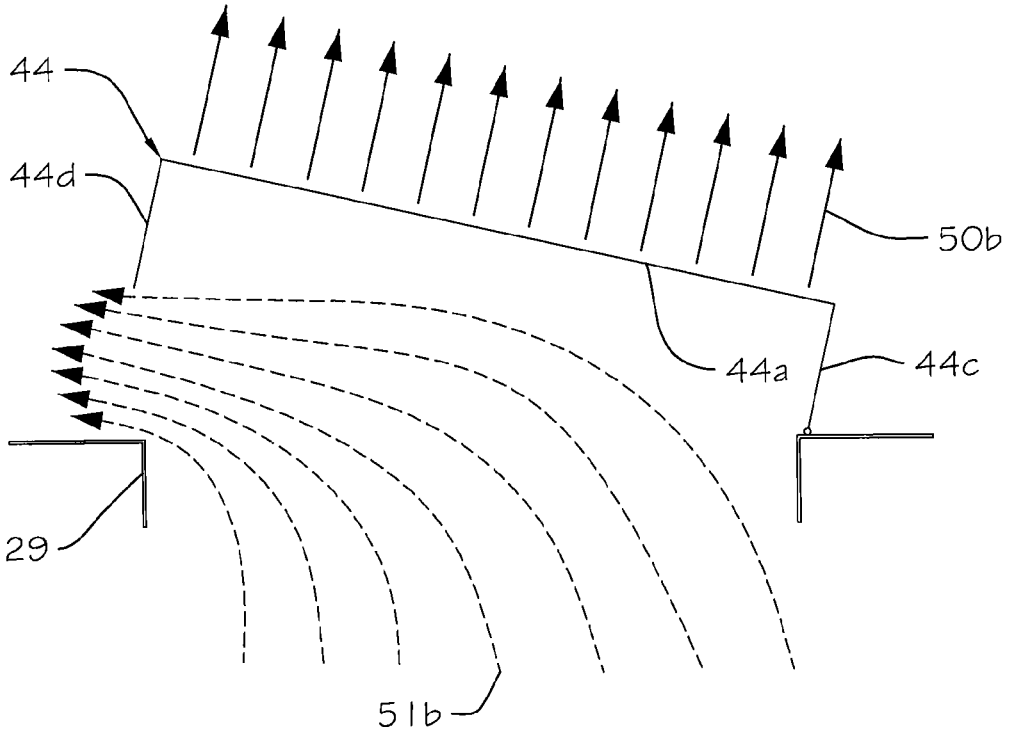
FIG. 4*b* is a schematic cross-section of a PCP hatch according to the first illustrative embodiment of the present invention, showing velocity lines and pressure gradients thereon.

Firstly and with reference to FIG. 4*a*, the geometry of the hatch cover greatly determines the manner in which it operates at pressure differentials above 0.15" w.g. The addition of the side walls 44*b*, 44*c* and 44*d* and their relative size influence its effective operation. When used to control relatively high pressures (at or above 0.45" w.g. such as in typical of commercially available direct fired gas burners), the velocity of the air escaping around the floating door 60 is relatively high (above 2500 feet per minute) and generates an associated "velocity pressure" or dynamic pressure as per the formula:

$$P_d=(V_{air}/4005)^2, \text{ where}$$

$P_d$=dynamic pressure (inches w.g.) and $V_{air}$=air velocity (feet per minute).

With no substantial pressure losses due to turbulence just upstream from the throat of the opening 29, the total pressure in the airstream at this location remains substantially constant. In accordance with Bernoulli's law of airflow:

$$P_t=P_d+P_s=\text{constant},$$

where $P_t$=total pressure, $P_d$=dynamic pressure and $P_s$=static pressure.

Based on this relationship, as the air accelerates approaching the opening to a maximum velocity at the throat of the opening, the static pressure decreases as the velocity of the airflow increases. The floating door 60 is reactive to this decrease in static pressure which tends to pull the floating door 60 towards the high velocity air flow (called also aerodynamic lift as with an airplane wing). Since the surface of the underside of the floating door 60 over which the drop in static pressure occurs increases with the quantity of air being shunted, so will the static pressure required to lift the floating door 60 further open. This is unacceptable since the required constant pressure for optimal burner combustion conditions is not met.

To overcome this adverse effect, side walls 44*b*, 44*c* and 44*d* are added to distance the lifting surface of the top panel 44*a* away from the zone of high velocity airflow at the perimeter of the hatch cover 44. Experimentally, an acceptable distance can been found such that the reduction in static pressure at high flow rates close to the top panel 44*a* becomes negligible (approximately five (5) inches (12.7 cm) for air velocities of three thousands (3000) feet per minutes (15.2 m/sec)).

Also, as can be seen in FIG. 1*a*, the side walls 44*b*, 44*c* and 44*d* can be made of unequal heights, for example when the dividing wall 41 is slanted. Upstream wall 44*c* being the pivot edge, it is reduced in height since substantially no air is shunted along its edge. Downstream wall 44*d* is made larger, positioning the top panel 44*a* further from the high velocity airflow at the edge of the downstream wall 44*d* as taught above.

A second phenomenon is the response of the hatch cover 44 to back pressure caused by less than ideal flow conditions downstream, i.e., changes in flow direction or obstacles in flow stream. As back pressure increases with an increase in airflow, it adds to the hatch cover opening pressure making the pressure at the burner opening 28 increase. This effect is detrimental to the desire pressure equilibrium.

Again, the proper selection of the height of the side walls can be used to correct this increase. As the height of the side walls is increased, the center of gravity rises further above the edge pivot axis. Thus, when the hatch begins to rotate upward, the horizontal distance between the center of gravity and the pivot axis decreases. This makes the hatch cover seem lighter and lighter as it rotates open. Less and less pressure is requires to lift it. The phenomena of reduced static pressure is now used to counteract the increase in back pressure. Thus the side wall heights are selected so that both the back pressure and static pressure variations cancel each other. This allows the pressure response of the hatch cover 44 to be tuned to a specific design of the heated ventilation system 10.

It is to be noted that the heights of the side walls of the hatch cover 44 are obtained through a calibration process when the hatch is installed, along with adding calibration weight as required onto the hatch cover. This may be necessary since sheet material used to fabricate the hatch cover is available in standard thicknesses and weights per square foot. Thus, the available material may not give the desired final weight and extra calibration weight may be required.

Figure 5:
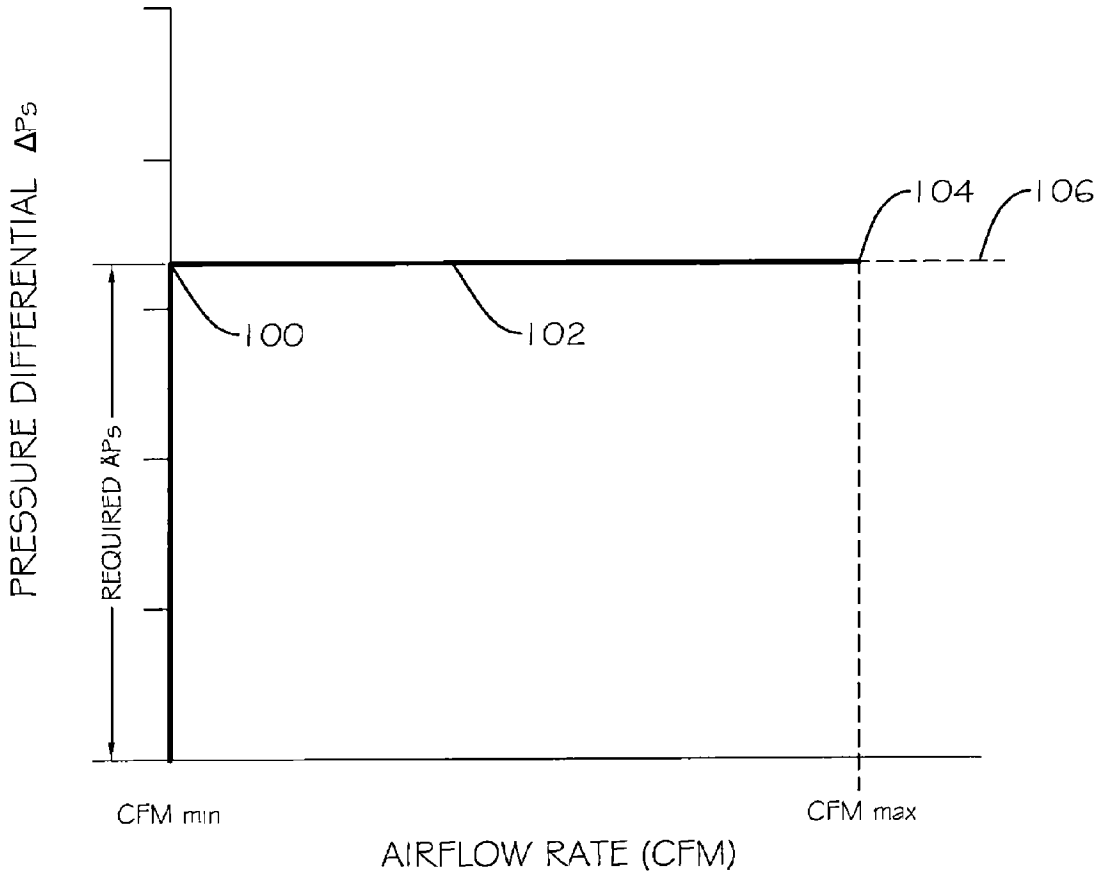
FIG. 5 is a graph showing the pressure response of the hatch according to the first illustrative embodiment.

A graphical representation of the "pressure versus airflow" characteristic through the hatch opening 29 is shown in FIG. 5 and will be used to illustrate the operation of the hatch cover 44.

As the pressure differential across the burner opening 28 begins to increase, substantially zero leakage occurs between the side walls 44*b*, 44*c* and 44*d* and the dividing wall 41 as the hatch cover 44 fully covers the hatch opening 29 (shown as a vertical line along the Y axis at zero airflow). It is to be noted that no sealing means is required between the hatch cover 44 and the dividing wall 41 if dividing wall 41 is made flat and matting edges of side walls 44*b*, 44*c* and 44*d* are made straight.

While the pressure differential $\Delta P_s$ remains below the threshold pressure level at point 100, the hatch cover 44 remains closed. As the pressure level attempts to increase above the pressure level at point 100, the hatch cover 44 begins to rise and shunt air. The airflow curve then becomes a horizontal line shown as segment 102. Any attempt to increase the pressure differential above point 100 results into an airflow increase (Cubic Foot per Minute (CFM)) at constant pressure.

When the hatch cover 44 reaches the designed maximum airflow (see intersection 104), the airflow may still be increased (see segment 106) with no impact on the pressure differential, until the hatch cover 44 is physically prevented from further opening, i.e. when a mechanical means, such as the side 47*b* of the groove 47, is used to restrain the pivoting of the hatch cover 44.

There is no hysteresis when the airflow decreases, since the operation of the hatch cover 44 is substantially frictionless (in fact the friction is 100% but no slippage is happening thus no frictional loses). Thus, the "return" or decreasing airflow curve is identical to the increasing pressure curve 102.

Thus, without any mechanical linkage, springs, electronic controls or measurements, the hatch cover 44 responds instantaneously to changes in the rotational speed of the blower fan 20 to regulate the air flow through the burner 42 at the optimal level.

The hatch cover 44 also responds to airflow variations caused by external factors. Such variations may be due to:

changes within the heated ventilation system 10, including the filters 32 becoming dirty or an accumulation of dirt on the fan wheel (not shown) of the blower fan 20;

changes in flow conditions within the building 13 such as adding or removing air diffuser, or building pressurization;

changes in atmospheric conditions such as wind gusts, frost build-up or temperature changes.

Regardless of the cause, the hatch cover 44 automatically responds to maintain a constant pressure drop across the burner opening 28 by shunting the required amount of air around the burner 42 and thereby regulate the airflow therethrough at the optimal amount.

The hatch cover is not limited to the first illustrative embodiment, nor to the configuration of the illustrated heated ventilation system 10.

As discussed hereinabove, the configuration of the hatch cover 44, including the weight and dimension of the side walls 44*a*, 44*b*, 44*c* and 44*d*, and the initial and final angular position thereof is adapted to the operating parameters of the heated ventilation system 10 and to the geometry of the bypass opening 29.

It should be apparent to those skilled in the art that many variations are possible from the first illustrative embodiment. Further characteristics and features of the PCP hatch will become apparent upon reading the following descriptions of further illustrative embodiments thereof.

Figure 6:
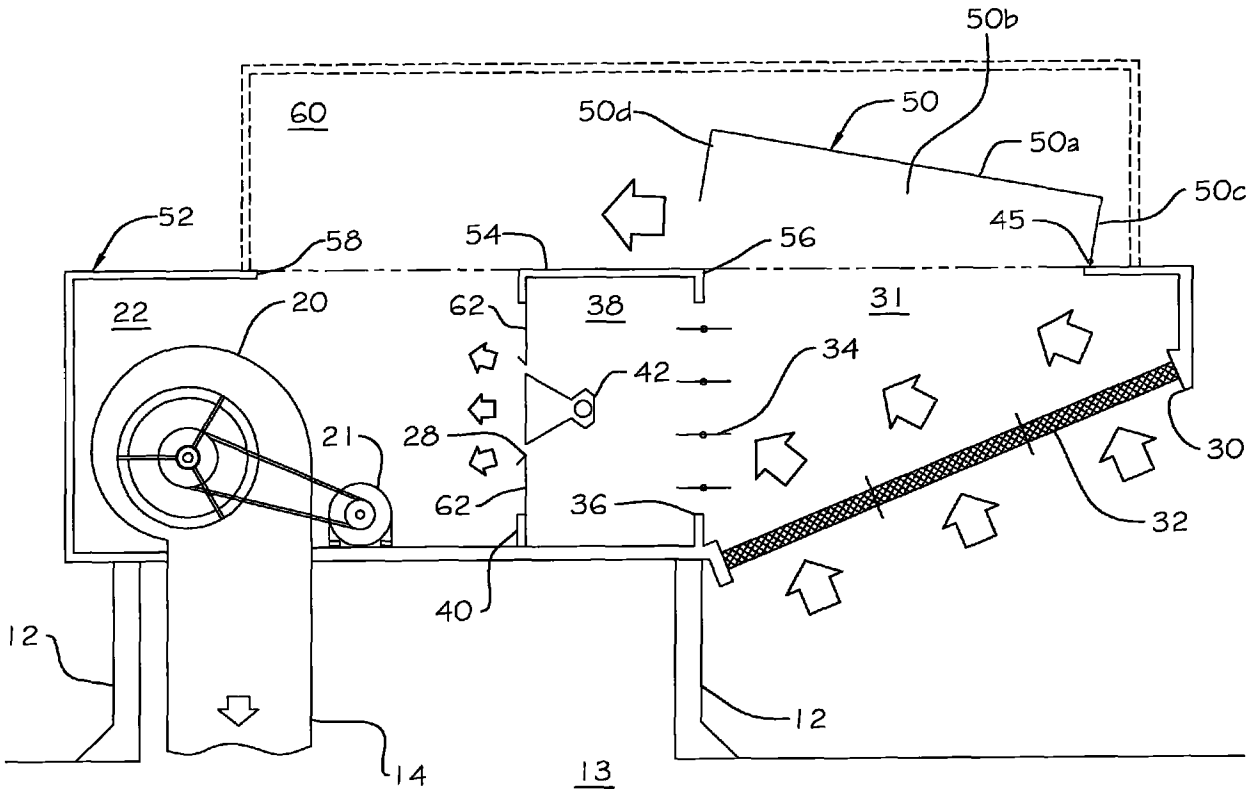
FIG. 6 is a cross-section of a DGF make-up air unit, including a PCP hatch according to a second illustrative embodiment; the PCP hatch being illustrated in an open position.

FIG. 6 shows an existing make-up air unit 10 retrofitted with a PCP hatch according to a second illustrative embodiment. Since the second embodiment is similar to the first embodiment, only the differences therebetween will be described herein for conciseness.

The configuration of a retrofit system 52 (shown in dashed lines) is particularly well adapted to convert conventional air make-up units from fixed flow units to variable flow units. According to this embodiment, the horizontal roof 54 of the existing make-up air unit 10 becomes the dividing wall 41 of the preferred embodiment. The side walls 50*b*, 50*c* and 50*d* of the hatch cover 50 are equal in height and extend downwardly from a substantially horizontal top panel 50*a*. Two openings are provided in the horizontal roof 54: opening 56 over the intake chamber 31 to receive the hatch cover 50 and a larger second opening 58 above the discharge chamber 22. A plenum chamber 60 is formed by the interior space within retrofit system 52 such that it becomes an extension of the discharge chamber 22 for shunting air directed from the hatch opening 56 towards the blower fan 20, and bypassing the burner chamber 38. Existing adjustable baffles 62 (also known as "profile plates") are then repositioned to yield the minimum allowable burner opening 28 around the burner 42. When the make-up air unit 10 is not in use, the damper 34 is closed and the hatch cover 50 closes opening 56, stopping air from escaping or entering the building.

Figure 7:
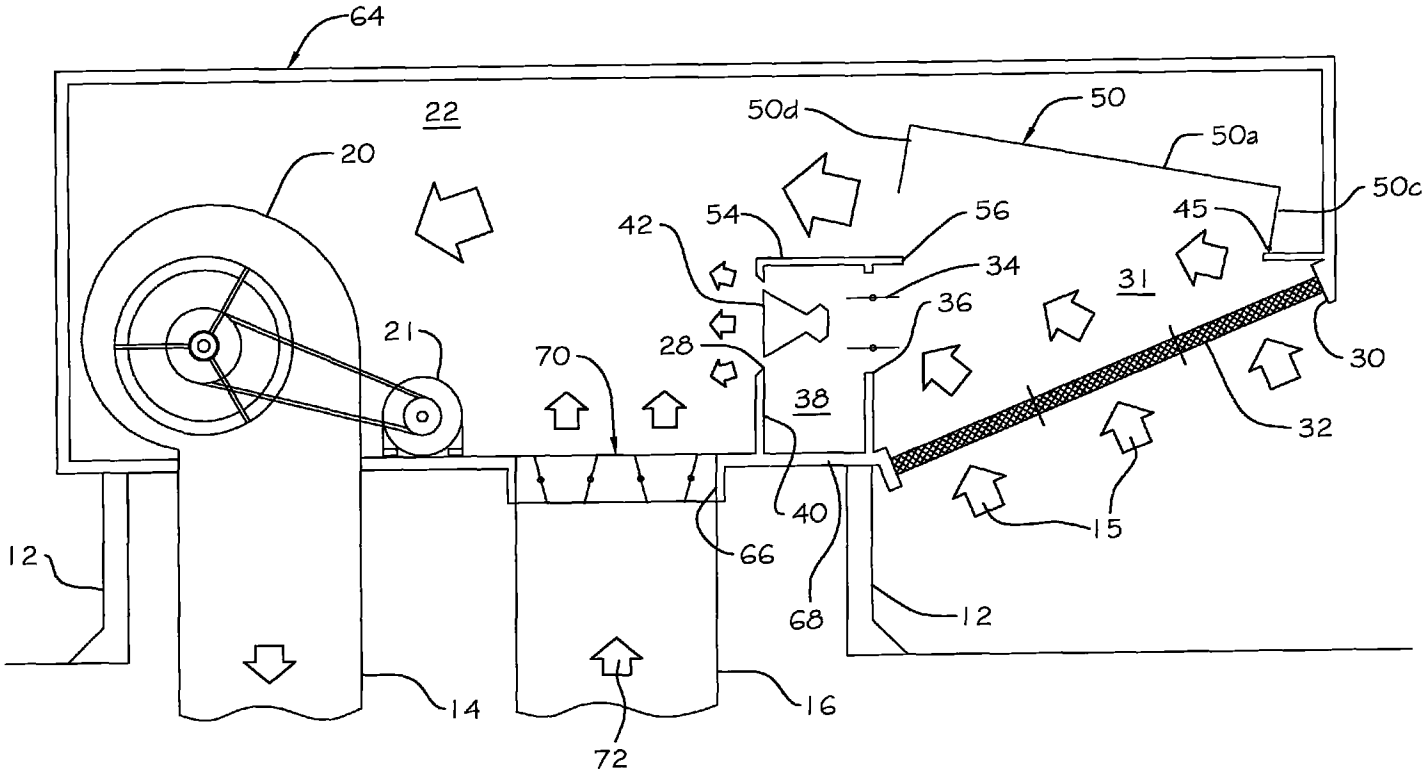
FIG. 7 is a cross-section of a DGF make-up air unit according to a third illustrative embodiment, including the PCP hatch illustrated in FIG. 6 with a recirculation damper.

With reference to FIG. 7, a third illustrative embodiment of an air make-up unit 64, incorporating the hatch cover 50, will now be described. Since the third embodiment is similar to the second embodiment, only the differences therebetween will be described herein for conciseness.

Downstream from the burner chamber 38 and before the supply fan 20, a damper opening 66 is cut within the floor wall 68 of the air make-up unit 64 and an adjustable recirculating damper 70 is provided therein to allow building air (see arrow 72) to be drawn into the discharge chamber 22 by blower fan 20.

The control of this damper 70 allows a variable amount of building air 72 to be admitted into the air make-up unit 64 so as to maintain the desired building inside/outside air pressure differential. Since adding air into the fan discharge chamber would tend to drop the pressure therein, the hatch cover 50 reacts by reducing by an equivalent amount the quantity of outside air coming through the hatch opening 56. At the blower fan 20, the flow of air is constant since the static pressure just upstream from the blower fan 20, as set by the hatch cover 50, remains unchanged.

The fresh outside air 15 can thus be varied from minimum flow set by the burner opening 28 to one hundred percent (100%) of the airflow range of the make-up air unit 64. This is achieved by adjusting the recirculating damper 70. With the required pressure drop at the hatch cover 50 being set by the burner combustion conditions, the maximum pressure drop through the recirculating damper 70 and its associated ductwork is adjusted to be equal to the required pressure drop at the burner 42. In this way, when the recirculating damper 70 is at its maximum opening, the air make-up unit is in eighty percent (80%) recirculation mode: the hatch cover 50 is substantially closed since the pressure downstream from the recirculating damper 70 has reached the pressure required to start lifting it off the opening. This combo damper system operates in unison without any mechanical interconnection and with a single control actuator (not shown) driving the recirculating damper 70. Since the pressure upstream from the blower fan is constant, the blower fan will deliver a constant airflow rate regardless of where the air is coming from: the recirculated air, heated outside air, cold outside air, or any mixture thereof.

Figure 8A:
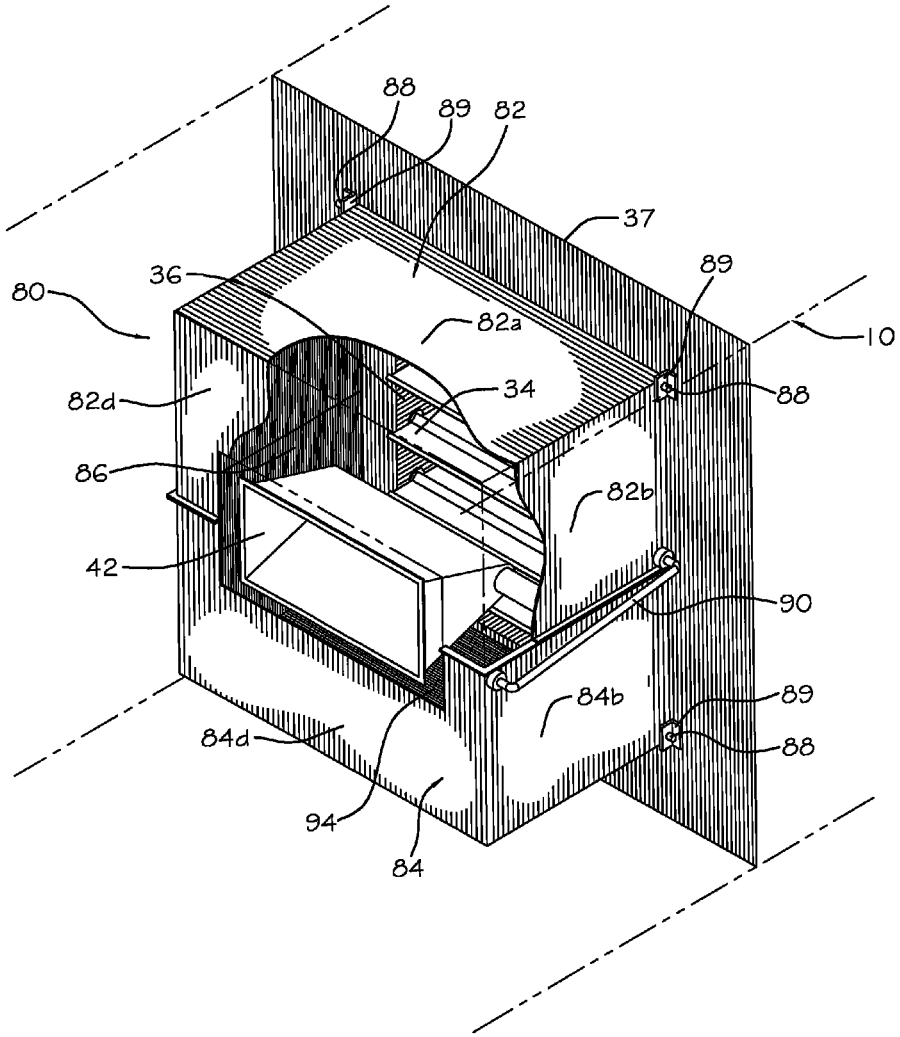
FIGS. 8*a* and 8*b* are perspective views of a PCP hatch according to a fourth illustrative embodiment; the pressure hatch being shown in respectively open and closed configurations.
Figure 8B:
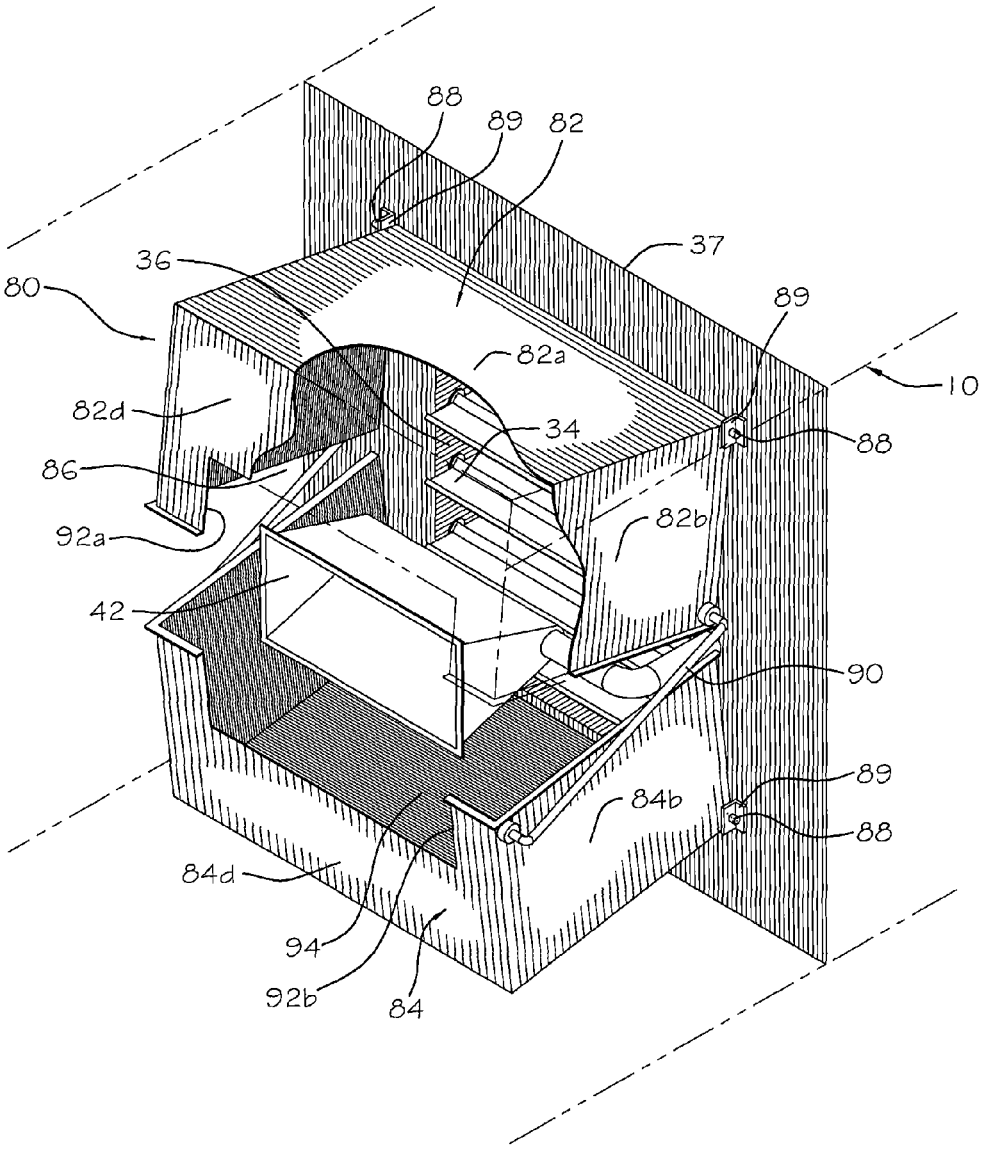

With reference now to FIGS. 8*a* and 8*b*, a passive pressure hatch cover 80 according to a fourth illustrative embodiment will now be described. Since the hatch cover 80 is installed in a heated ventilation system that is similar to the system 10, only the differences between these two make-up units will be described herein for conciseness.

According to this fourth illustrative embodiment, the fixed burner chamber 38 is removed and replaced by a pair of opposing modified hatch covers: a top hatch cover 82 above burner 42 and a bottom hatch cover 84 below thereof. The top and bottom hatch covers 82 and 84 defines the hatch cover assembly 80 and a variable burner chamber 86 therein.

The top hatch cover 82 includes a top panel 82*a*, a pair of spaced sidewalls 82*b*, a downstream wall 82*d* and pivot pins 88. The bottom hatch cover 84 includes a top panel 84*a*, a pair of spaced sidewalls 84*b*, a downstream wall 84*d* and pivot pins 88. No upstream walls are required. The pivot pins 88 are pivotally mounted in brackets 89 which are fixedly mounted to the back wall 37. Back wall 37 has the same functions as in previous embodiments in that it allows the fresh outside air to enter the burner chamber 86 through an inlet opening 36 in which an inlet damper 34 is mounted.

The closed position of the hatch cover assembly 80 corresponds to the minimum air flow. In this position, the adjacent side walls 82*b* and 84*b* rest against each other and against the back wall 37 as shown in FIG. 8*a*.

The hatch cover assembly 80 is made movable between the close position of FIG. 8*a* and the open position illustrated in FIG. 8*b*. The two adjacent side walls 82*b* and 84*b* are linked by U-shaped link rods 90 such that the hatch covers 82 and 84 pivot in unison and in opposite directions away from burner 42 and from the back wall 37. One end of each link rod 90 is attached to the side wall 82*b* near the corner thereof that is close to the back wall 37 and adjacent to the side wall 84*b*; the opposite end of the link rod 90 is attached to the side wall 84*b* near the corner thereof that is closest to both the side wall 84*d* and the side wall 82*b*. Both side walls 82*d* and 84*d* have complementary U shaped openings 92*a* and 92*b* that together yields an adjustable burner opening 94.

According to this embodiment, the weight of the top hatch cover 82 is counterbalanced by the weight of the bottom hatch cover 84. Calibration weights (not shown) are added onto the top cover hatch 82 to obtain the biasing pressure for optimum combustion conditions at the burner 42 as discussed hereinabove. The weights are attached to the side walls 82*b* and are positioned to fine tune the response of the hatch covers 82 and 84 as they pivot about their pivot pins 88. The positioning of the weights allows corrections:

for the varying area of the horizontal projection of both hatch covers 82 and 84 which increases as they open;

while the center of gravity moves horizontally away from the pivot points at pivot pins 88.

With the increase in projected area, the pressure required to move the hatch covers 82 and 84 into their open position decreases. Oppositely, with the center of gravity moving horizontally away from the pivot points at pivot pins 88, the pressure required to move the hatch cover 82 and 84 into their open position increases. It can be made to increase further by positioning calibration weight on side walls 82*b* near the back wall 37 distal from the pivot pins 88.

No additional hatch, controls, actuators or dampers are required in other than the hatch defined by the cover assembly 80.

The linkage between the top and bottom hatch covers 82 and 84 is not limited to the link rod 90 and other mechanism can be provided to force the movement thereof in unison. For example, fork-shaped elements can be mounted on top or bottom covers 82 and 84 and guide rods be fixedly mounted to the other cover such that the rods can slide within the fork-shaped elements. To reduce the friction, a frictionless bearing can be included on the guide rod to substantially eliminate the friction as the guide rods move up and down within the fork-shaped elements, making the hatch covers 82 and 84 operate in unison and in opposite directions. According to a second embodiment (not shown) the link rods 90 are replaced by a multi-strand cable wire. The attachment points are as described with reference to the previous embodiment, but the multi-strand cable wire being flexible, no pivot points would be required as with the ends of the link rods 90.

It is believed to be within the reach of a person skilled in the art to use the present teaching to adapt the heated ventilation systems 10, 52 or 64 to receive the hatch cover 80. It is to be understood that embodiments of the PCP hatch cover and of air make-up systems incorporating such PCP hatch covers are not limited in their application to the details of construction and parts illustrated in the accompanying drawings and described hereinabove. A PCP hatch cover and air make-up systems incorporating such hatch cover are capable of other embodiments and of being practiced in various ways.

Further applications of the PCP hatch will now be described.

An illustrative embodiment of a PCP hatch as described hereinabove is incorporated into "Air-Side Economizer Systems" as shown in FIGS. 9*a* to 11*b*. Air side economizer systems are designed to take advantage of outside condition to afford free cooling when cooling is required. This is usually done by a modulating damper or set of dampers used to control the outdoor airflow drawn into the heating, ventilating and air conditioning (HVAC) system in excess of minimum ventilation outdoor air to allow free cooling. To do so, varying quantities of cool outside fresh air is mixed with warm inside air such that the mixture has the appropriate temperature to meet the air-conditioning needs of a building and thus reduce or eliminate the use of the air-conditioning system compressor. In some cases, only outside air may be used.

As defined by ASHREA (American Society of Heating, Refrigeration and Air-Conditioning Engineers) Guideline 16-2003 several arrangements are suggested to achieve the free cooling needs. The most common variations are:

arrangement 1 (FIG. 9*a*—Prior art): HVAC system with a return fan;

arrangement 2 (FIG. 10*a*—Prior art): HVAC system with a relief fan;

arrangement 3 (FIG. 11*a*—Prior art): HVAC system with a gravity or motorized relief damper.

Refer to "ASHREA Guideline 16-2003" for more details.

By the incorporation of PCP hatches, the HVAC systems are greatly simplified requiring in most cases only one control damper, fewer controls components such as actuators, multi-blade dampers, pressure sensors or differential pressure controllers. The operation of PCP hatches has much better pressure and flow control as compared to the use of motorized dampers especially when two (2) motorized dampers are used as a constant flow mixing box. In such a configuration, one damper opens while the second damper closes and at the same time, maintain a constant total quantity of air through the mixing box as pressures upstream of both dampers vary.

Figure 9A:
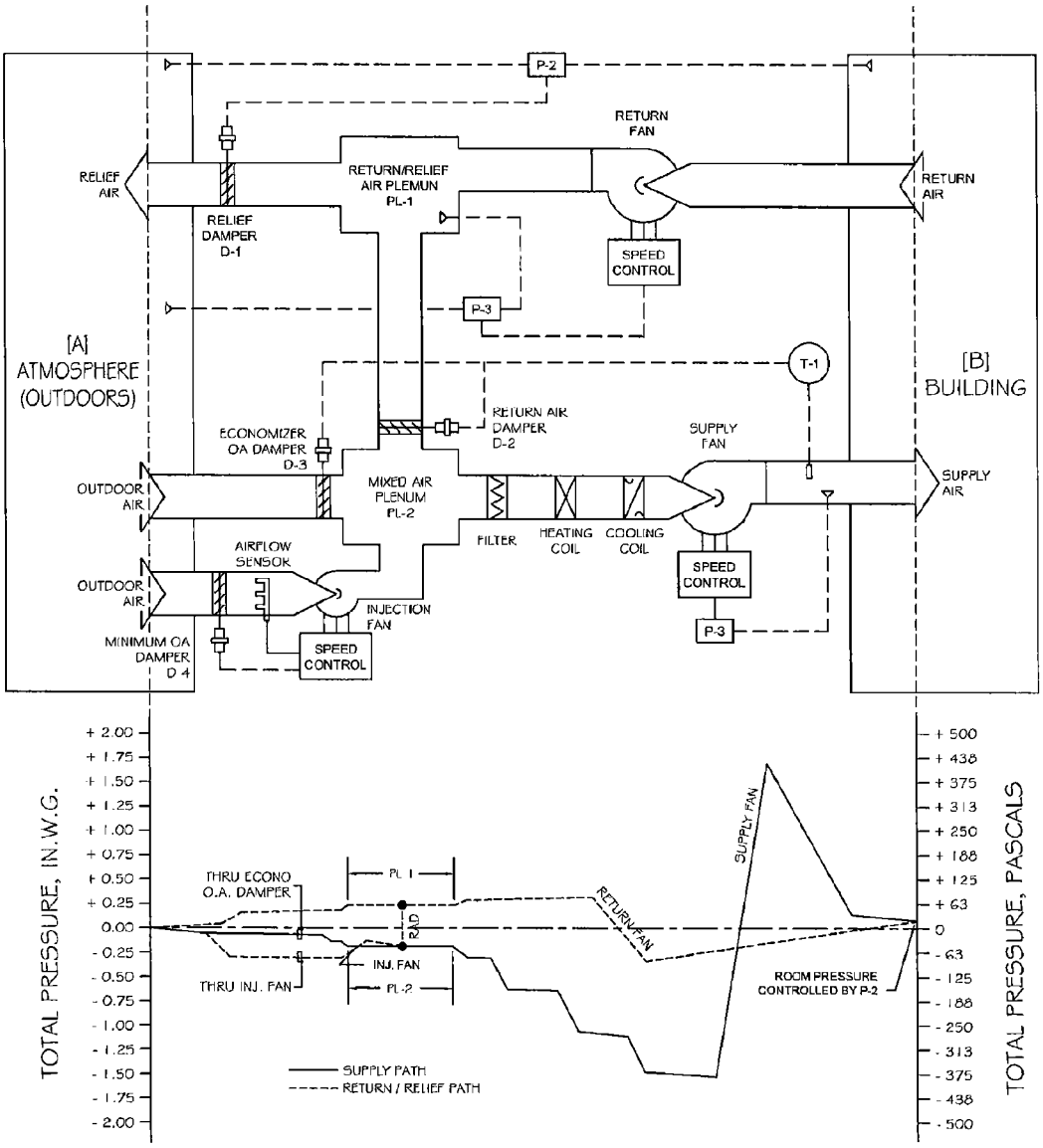
FIG. 9a (PRIOR ART)
FIG. 9*a*, which is labeled "Prior Art', and FIG. 9*b* are schematic views with corresponding pressure graphs of an heating, ventilating and air conditioning (HVAC) system with a return fan according to the ASHREA (American Society of Heating, Refrigeration and Air-Conditioning Engineers) Guideline 16-2003, respectively with and without a hatch cover from FIG. 2.
Figure 9B:
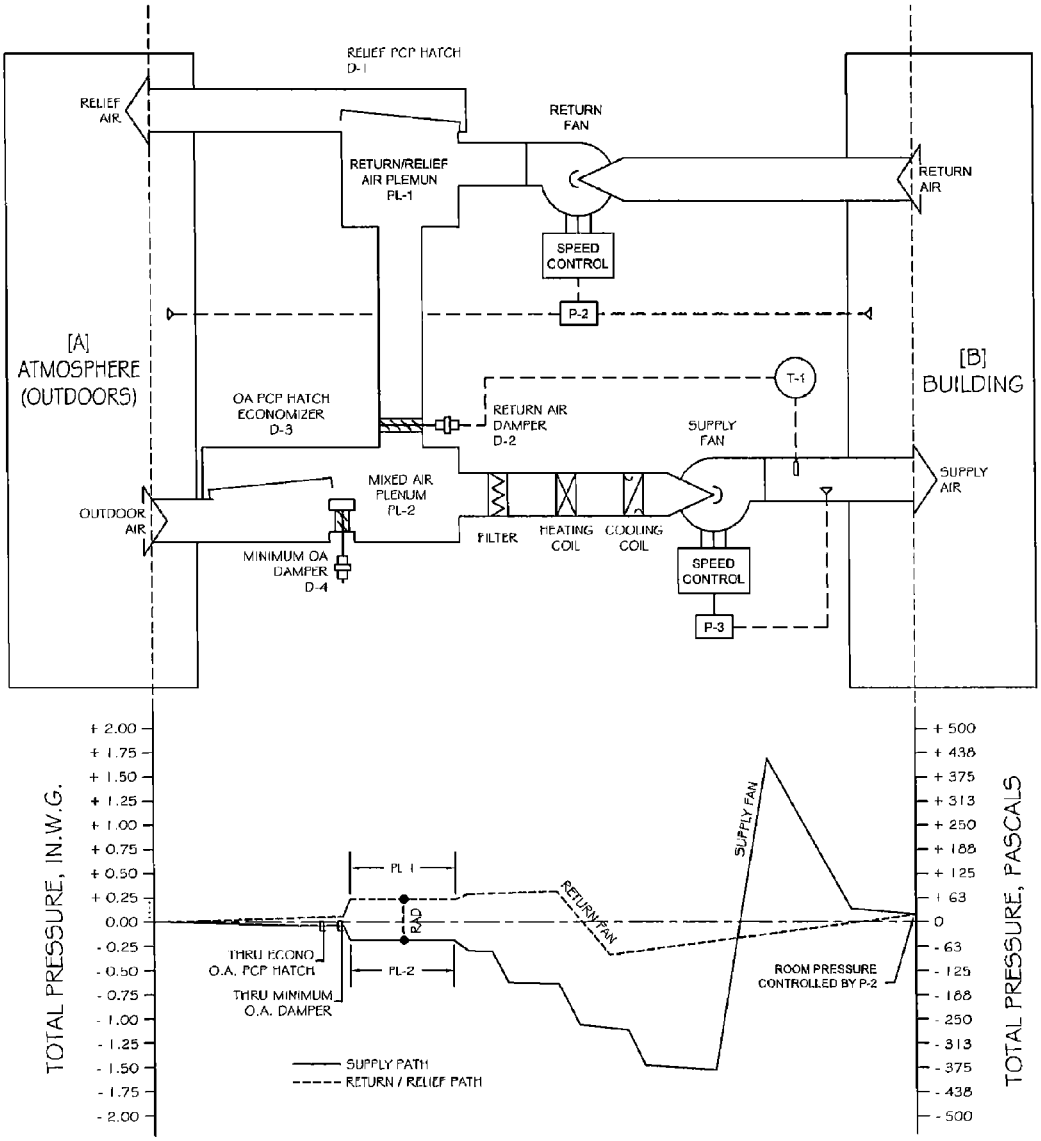

Referring to FIG. 9*a*—Prior art, the known arrangement for the "HVAC system with return air fan (with minimum outside air control)" is shown. Referring now to FIG. 9*b*, the proposed arrangement of the "HVAC system with return air fan (with minimum outside air control)" using PCP hatches is shown. As can be seen, the assembly using the PCP hatches is simpler, requiring:

1. two (2) fewer actuators (at D-1 & D-3),
2. one (1) less fan (injection fan),
3. one (1) less pressure controller (P-3),
4. one (1) less airflow sensor (at injection fan) and
5. one (1) less speed control (at injection fan).

In FIGS. 9*a* to 11*b*, the graphs show the pressure variations in the ducts.

With the PCP hatch in air plenum PL-1, pressure in the plenum is now constant. With the PCP hatch in air plenum PL-2, pressure in this plenum is also constant. This entails that the pressure drop across damper D-2 is fixed. The pressure in plenum PL-1 is selected to be equal the minimum pressure required to lift the PCP hatch D-1. The pressure in plenum PL-2 is designed to be equal to the pressure in plenum PL-1 minus the pressure drop through the return air damper when full open at maximum design airflow. The pressure drop through the minimum outside air (OA) damper is fixed (pressure in PL-2) so once adjusted, a modulating actuator is no longer required. A two-position actuator (open/closed) is used to allow closure of the minimum outside air damper when the HVAC system in not in operation. Both hatches are calibrated as taught above to account for back-pressure associated with the ductwork: downstream from the D-1 relief PCP hatch and upstream from the D-3 OA PCP hatch economizer.

Figure 10A:
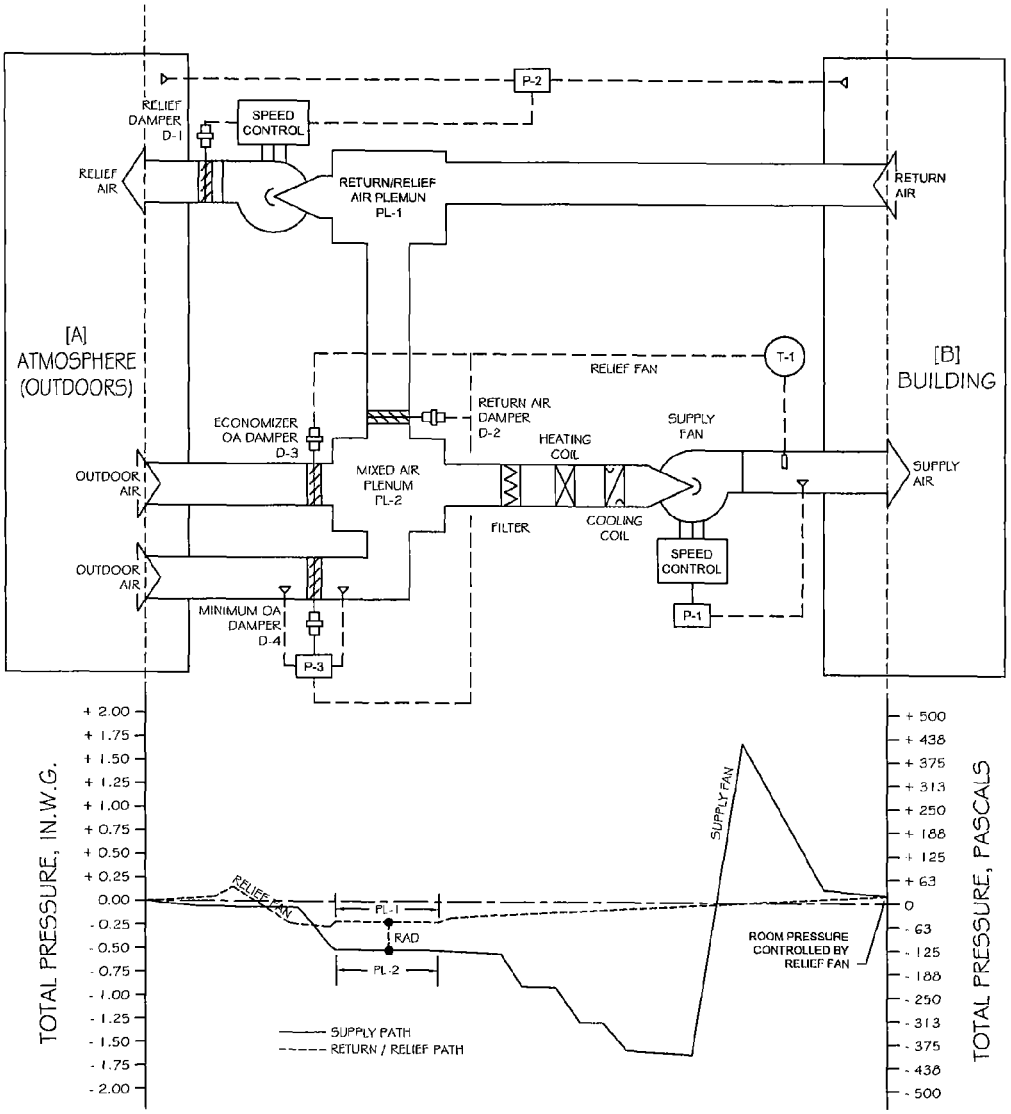
FIG. 10a (PRIOR ART)
FIG. 10*a*, which is labeled "Prior Art', and FIG. 10*b* are schematic views with corresponding pressure graphs of an HVAC system with a return fan according to the ASHREA Guideline 16-2003, respectively with and without a hatch cover from FIG. 2.
Figure 10B:
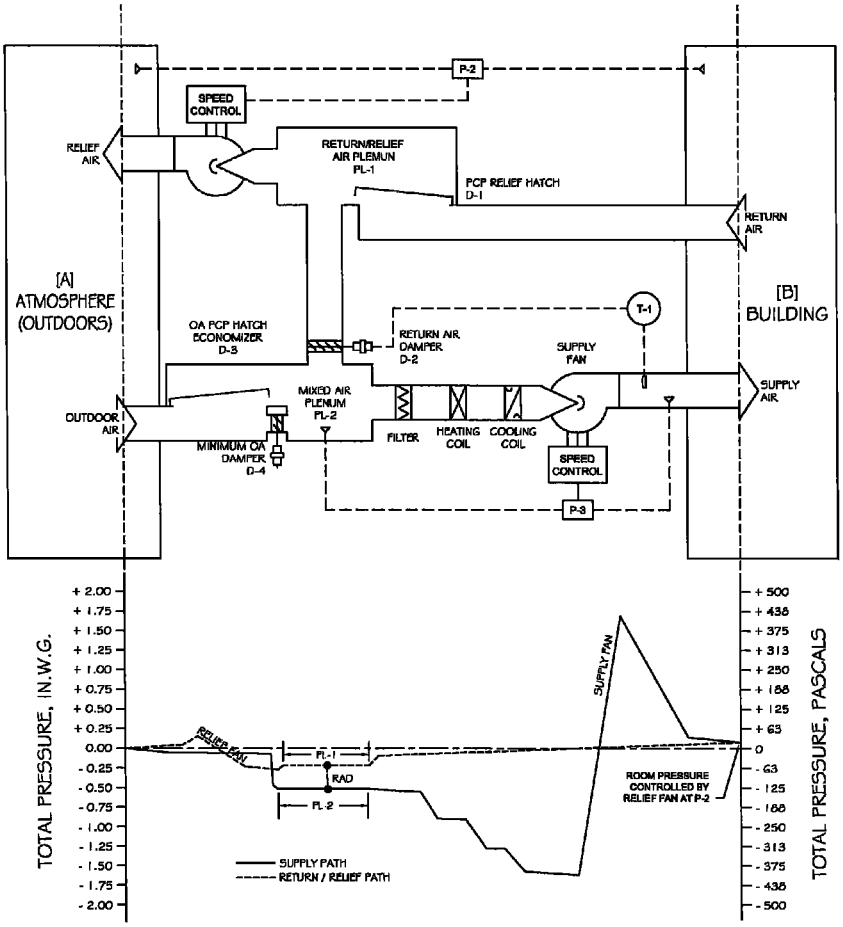

Referring now to FIG. 10*a*—Prior art, the known arrangement for the "HVAC system with relief fan (with minimum outside air control)" is shown. Referring now to FIG. 10*b*, the proposed arrangement of the "HVAC system with relief fan (with minimum outside air control)" using PCP hatches is shown. As can be seen, the assembly using the PCP hatches is simpler, requiring:

1. two (2) fewer actuators (at D-1 & D-3),
2. one (1) less pressure controller (P-3) and,
3. one (1) less airflow sensor (at D-4).

With the PCP hatch in air plenum PL-1, pressure in the plenum is now constant. With the PCP hatch in air plenum PL-2, pressure in this plenum is also constant. This entails that the pressure drop across damper D-2 is fixed. The negative pressure in plenum PL-1 is selected to be equal the minimum pressure required to lift the PCP hatch D-1. The pressure in plenum PL-2 is designed to be equal to the pressure in plenum PL-1 minus the pressure drop through the return air damper when full open at maximum design airflow. The pressure drop through the minimum outside air (OA) damper is fixed (pressure in PL-2) so once adjusted, a modulating actuator is no longer required. A two-position actuator (open/closed) is used to allow closure of the minimum outside air damper when the HVAC system in not in operation. Both hatches are calibrated as taught above to account for back-pressure associated with the ductwork: upstream from the D-1 relief PCP hatch and upstream from the D-3 OA PCP hatch economizer.

Figure 11A:
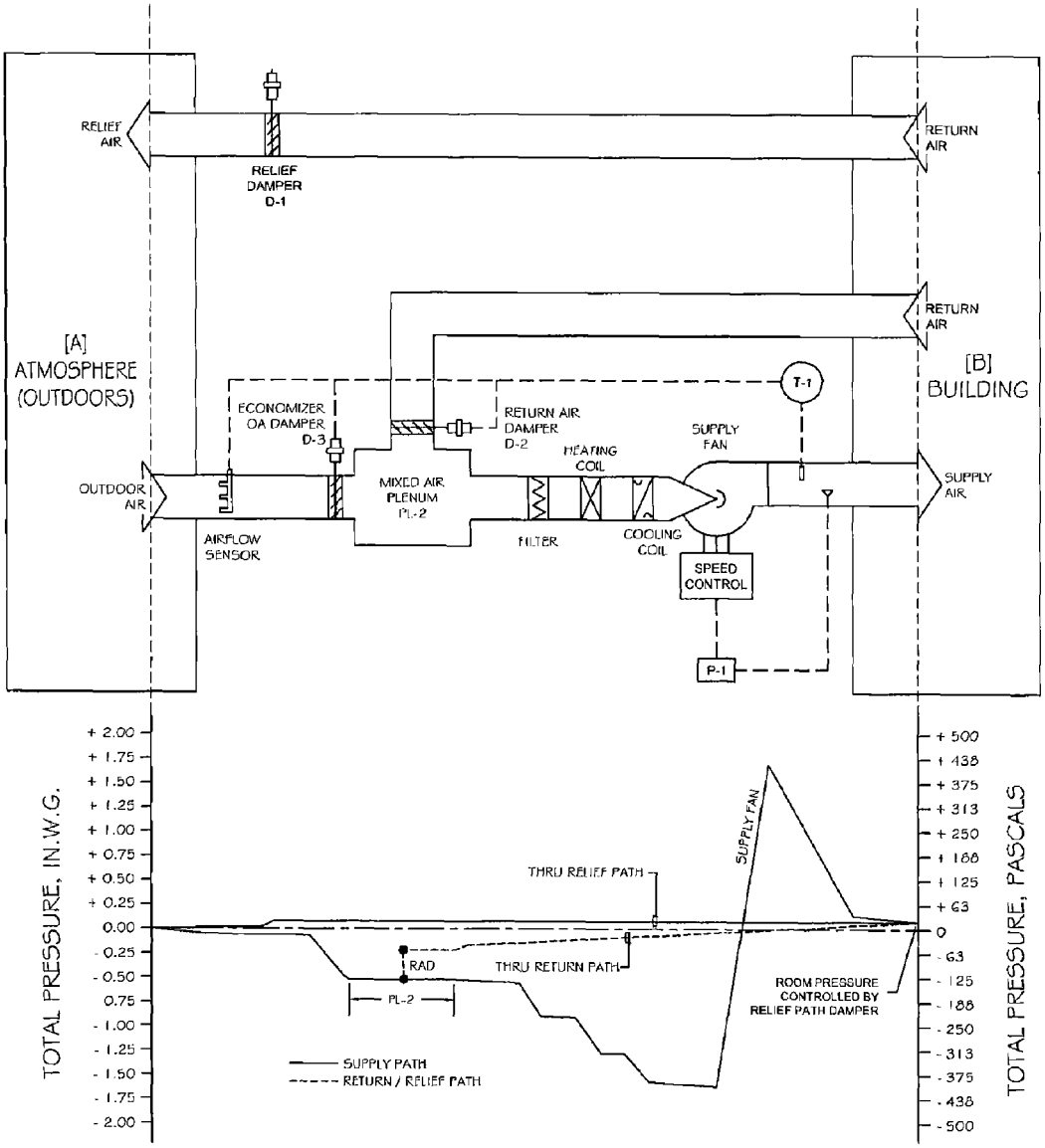
FIG. 11a (PRIOR ART)
FIG. 11*a*, which is labeled "Prior Art', and FIG. 11*b* are schematic views with corresponding pressure graphs of an HVAC system with a gravity or motorized relief damper according to the ASHREA Guideline 16-2003, respectively with and without a hatch cover from FIG. 2.
Figure 11B:
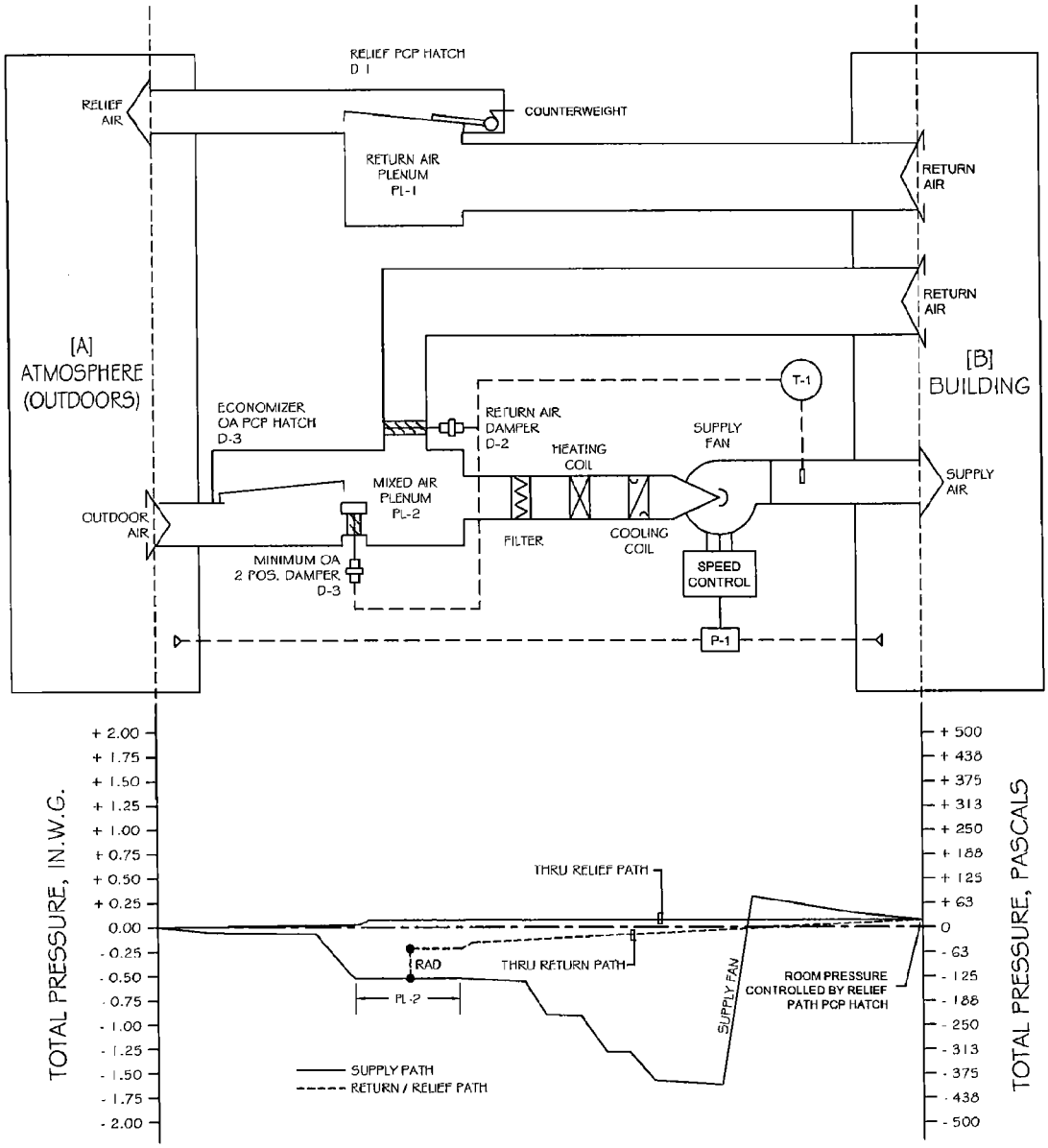

Referring now to FIG. 11*a*—Prior art, the known arrangement for the "HVAC system with a gravity or motorized relief damper fan (with minimum outside air control)" is shown. Referring now to FIG. 11*b*, the proposed arrangement of the "HVAC system with a gravity or motorized relief damper fan (with minimum outside air control)" using PCP hatches is shown. This configuration yields a pressurized building space as might be required for clean rooms or operating rooms where introduction of unfiltered air is not allowed. The response time of the system when using a PCP hatch is quicker with instant response to changes in building pressure. As can be seen, the assembly using the PCP hatches is simpler, requiring:

1. one (1) fewer actuator (at D-1) and
2. one (1) less airflow sensor (at D-3).

With the PCP hatch in air plenum PL-1, pressure in the plenum is now constant. With the use of a counterweight of the PCP hatch D-1, the PCP hatch can be adjusted to a very low opening pressure regardless of the total weight of the hatch cover. In air plenum PL-2, pressure is also constant. This entails that the pressure drop across damper D-2 is fixed. The positive building pressure is sensed in plenum PL-1 and is equal to the minimum pressure required to lift the PCP hatch. The pressure in plenum PL-2 is designed to be equal to the pressure in plenum PL-1 minus the pressure drop through the return air damper when full open at maximum design airflow. The pressure drop through the minimum outside air (OA) damper is fixed (pressure in PL-2) so once adjusted, a modulating actuator is no longer required. A two-position actuator (open/closed) is used to allow closure of the minimum outside air damper when the HVAC system in not in operation. Both hatches are calibrated as taught above to account for back-pressure associated with the ductwork: upstream from the D-1 relief PCP hatch and upstream from the D-3 OA PCP hatch economizer It is also to be understood that the phraseology or terminology used herein is for the purpose of description and not limitation.

What is claimed is:

1. A direct gas-fired fresh air heating system comprising;
an air intake chamber;
a discharge chamber;
a burner chamber in fluid communication with both the air intake and discharge chambers therebetween;
a direct-gas fired (DGF) heater mounted in the burner chamber to heat air flowing therethrough from the air intake chamber to the discharge chamber; and
a passive constant pressure (PCP) hatch including:
a bypass opening between the air intake and discharge chambers to allow air to be shunted passed the burner chamber; and
a PCP hatch cover having a top panel covering the bypass opening; the PCP hatch cover being movable between a first position, wherein the PCP hatch cover closes the bypass opening and a second position wherein the PCP hatch cover is lifted away from the bypass opening so as to substantially maintain a fixed pressure differential across the burner chamber; the PCP hatch cover being configured to lift further away from the bypass opening when there is an attempt to increase the pressure differential between the air intake and discharge chambers;
the improvement comprising:
the PCP hatch cover further including a peripheral wall extending from the top panel to distance the top panel from the bypass opening when the PCP hatch cover is in the first position;
whereby negative effects of aerodynamic lift on the top panel and an inherent reduction of static pressure associated thereto, are substantially reduced throughout.

2. A fresh air heating system as recited in claim 1, wherein the bypass opening is in a dividing wall between the air intake and discharge chambers; the hatch cover being pivotally mounted to the dividing wall.

3. A fresh air heating system as recited in claim 2, wherein the hatch cover further includes two tabs that extend from opposite side portions of the peripheral wall; each tab being inserted in a V-shaped opening in a respective bracket secured to the dividing wall.

4. A fresh air heating system as recited in claim 3, wherein the V-shaped opening includes a first side and a second side that is slanted relative to the first side; the first and second sides intersecting at a truncated apex that has a width substantially equal to the thickness of the tabs; whereby the angle formed by the first side and the second side defines a maximum angular rotation of the PCP hatch cover.

5. A fresh air heating system as recited in claim 2, wherein the burner chamber defines a passage for said fluid communication with both the air intake and discharge chambers therebetween; the PCP hatch cover defining a first hatch cover portion; the PCP hatch cover further including a bottom hatch cover portion defining together a variable opening of the burner chamber to increase the fluid passage; each of the top and bottom cover portions being pivotally mounted to the dividing wall for movement in unison and in opposite directions between the close position and the open position, wherein the fluid passage is increased.

6. A fresh air heating system as recited in claim 5, wherein adjacent side walls from the top and bottom cover portions are linked for the movement in unison.

7. A fresh air heating system as recited in claim 1, wherein the peripheral wall is characterized by a height which varies therealong.

8. A fresh air heating system as recited in claim 1, wherein the peripheral wall is characterized by a height which is constant therealong.

9. A fresh air heating system as recited in claim 1, wherein the hatch cover is characterized by having a weight that opposes an air pressure force acting on the panel over a range of air flow volumes shunted through the bypass opening.

10. A fresh air heating system as recited in claim 1, wherein the air intake chamber has an opening for receiving air from the outside; the discharge chamber having an outlet opening and a blower fan for sending air into a building.

11. A fresh air heating system as recited in claim 1, wherein filters are mounted in the air intake chamber to filter the air from the outside.

12. A fresh air heating system as recited in claim 1, further comprising a blower fan in the discharge chamber which draws the air flowing through the burner chamber from the air intake chamber.

13. A fresh air heating system as recited in claim 12, further comprising a recirculation damper mounted in a fluid passage between the discharge chamber and an inner space; the blower fan further drawing air into the discharge chamber through the recirculation damper, wherein the amount of air drawn through the recirculation damper is controlled by the recirculation damper.

14. A passive control hatch cover for selectively closing a bypass opening between an air intake chamber and a discharge chamber, the passive control hatch cover comprising a lifting surface covering the bypass opening and a peripheral wall that extends from the lifting surface so as to distance the lifting surface from the bypass opening when the passive control hatch closes the bypass opening.

15. A constant air pressure unit for an air handling system, said unit comprising a partition therein having an air passage opening to allow pressurized air to fluidly circulate therethrough, a door having a panel displaceably retained over the air passage opening such that, in a closed position of the door, substantially no air can pass through the air passage opening; the door panel having loading means whereby the door is caused to move away from the air passage opening when a pressure differential across the partition attains a desired level; the door panel further allowing the controlled passage of air through the air passage opening while maintaining a substantially constant air pressure differential across the partition, the improvement wherein the door further includes a peripheral wall which comes in contact with the partition when the door fully covers the air passage opening and that distances the door panel from the air passage opening when the door closes the air passage opening.

* * * * *